US012471729B2

(12) United States Patent
Montgomery et al.

(10) Patent No.: US 12,471,729 B2
(45) Date of Patent: Nov. 18, 2025

(54) BRACKET SYSTEM AND METHOD

(71) Applicant: Boom Hardware LLC, North Salt Lake, UT (US)

(72) Inventors: Scott Montgomery, Idaho Falls, ID (US); Steven Montgomery, North Salt Lake, UT (US); Michelle O'neal, North Salt Lake, UT (US)

(73) Assignee: Boom Hardware LLC, North Salt Lake, UT (US)

( * ) Notice: Subject to any disclaimer, the term of this patent is extended or adjusted under 35 U.S.C. 154(b) by 105 days.

(21) Appl. No.: 18/131,794

(22) Filed: Apr. 6, 2023

(65) Prior Publication Data

US 2023/0397751 A1 Dec. 14, 2023

Related U.S. Application Data

(63) Continuation-in-part of application No. 17/839,375, filed on Jun. 13, 2022, now Pat. No. 12,318,047.

(51) Int. Cl.

| | |
|---|---|
| ***A47H 1/00*** | (2006.01) |
| ***A47H 1/142*** | (2006.01) |
| ***A47K 10/10*** | (2006.01) |

(52) U.S. Cl.

CPC ..... *A47H 1/142* (2013.01); *A47K 10/10* (2013.01)

(58) Field of Classification Search

None

See application file for complete search history.

(56) References Cited

U.S. PATENT DOCUMENTS 1,838,935 A * 12/1931 Fixsen ..... A47B 95/02 248/222.52

4,432,504 A 2/1984 Pace (Continued)

FOREIGN PATENT DOCUMENTS

CN 201205252 Y 3/2009
FR 2623575 A1 5/1989

(Continued)

OTHER PUBLICATIONS

PCT/US2023/023607 filed May 25, 2022 International Search Report and Written Opinion dated Aug. 28, 2023.

(Continued)

*Primary Examiner* — Steven M Marsh

(74) *Attorney, Agent, or Firm* — Rutan & Tucker LLP

(57) ABSTRACT

Embodiments include a bracket system for coupling to a wall having an exterior layer supported by a support beam. The bracket system includes an anchor having a flange, a stud portion extending rearwards, and a block portion extending frontwards. Embodiments also include a dual anchor system. The stud portion extends through the exterior layer to engage the support beam, or a support arm assembly. The flange engages a front surface of the exterior layer. The bracket includes a socket that slidably engages the block portion. When the block portion is engaged with the socket, a bolt hole of the block portion aligns with a bolt hole of the bracket. A bolt extends transversely through the bolt holes to secure the bracket to the anchor. The bracket includes a ring or can engage a rod. The rod can be releasably engaged with the bracket using a magnetic element.

8 Claims, 15 Drawing Sheets

(56) References Cited

U.S. PATENT DOCUMENTS

| | | | | |
|---|---|---|---|---|
| 5,664,751 | A * | 9/1997 | Lan | A47K 10/04 248/251 |
| 5,875,903 | A | 3/1999 | Chen | |
| 6,430,759 | B1 * | 8/2002 | Beltran | A47K 10/10 248/251 |
| 6,595,478 | B2 * | 7/2003 | Lee | A47H 1/102 248/262 |
| 6,651,830 | B2 | 11/2003 | Pan | |
| 7,111,336 | B1 | 9/2006 | Lai | |
| 7,967,522 | B2 | 6/2011 | Goad | |
| 8,342,771 | B2 | 1/2013 | Goad | |
| 8,382,051 | B2 | 2/2013 | Smith | |
| 8,387,931 | B2 | 3/2013 | Forrest | |
| 8,430,369 | B2 * | 4/2013 | Hsu | A47K 10/04 248/221.11 |
| 9,089,245 | B1 * | 7/2015 | Pamphilis | A47K 10/04 |
| 9,715,960 | B2 | 7/2017 | Chaizy | |
| 9,955,827 | B2 | 5/2018 | Morris | |
| 11,006,786 | B1 * | 5/2021 | Daniels | A47K 10/10 |
| 11,058,245 | B2 | 7/2021 | Wright et al. | |
| 11,643,820 | B2 | 5/2023 | Kuo | |
| 2002/0104946 | A1 | 8/2002 | Lai | |
| 2003/0099525 | A1 | 5/2003 | Michels | |
| 2006/0022098 | A1 | 2/2006 | De Backer | |
| 2008/0048079 | A1 | 2/2008 | Albritton et al. | |
| 2009/0205123 | A1 | 8/2009 | Forrest | |
| 2009/0206220 | A1 | 8/2009 | Forrest et al. | |
| 2009/0242713 | A1 | 10/2009 | Lowe et al. | |
| 2011/0150600 | A1 | 6/2011 | Spencer, Jr. et al. | |
| 2014/0271031 | A1 | 9/2014 | Agri et al. | |
| 2021/0137326 | A1 | 5/2021 | Edwards et al. | |
| 2023/0397779 | A1 | 12/2023 | Montgomery et al. | |

FOREIGN PATENT DOCUMENTS

| | | | |
|---|---|---|---|
| JP | 6501860 | B2 | 4/2019 |
| WO | 2023244429 | A1 | 12/2023 |

OTHER PUBLICATIONS

U.S. Appl. No. 17/839,375, filed Jun. 13, 2022 Non-Final Office Action dated Aug. 15, 2024.

* cited by examiner

BRACKET SYSTEM AND METHOD

PRIORITY

This application is a continuation-in-part of U.S. patent application Ser. No. 17/839,375, filed Jun. 13, 2022, now U.S. Pat. No. 12,318,048, which is incorporated by reference in its entirety into this application.

SUMMARY

Briefly summarized, embodiments of the present invention are directed to a bracket system for coupling to a wall, the wall having an exterior layer supported by a support beam. The bracket system includes an anchor having a flange, a stud portion extending rearwards, and a block portion extending frontwards. The stud portion extends through the exterior layer of the wall to directly engage the support beam. The flange can engage a front surface of the exterior layer of the wall to further stabilize the anchor. An anchor screw extends through an anchor screw hole to secure the anchor to the support beam. A bracket includes a socket configured to slidably engage the block portion. When the block portion is engaged with the socket, a bolt hole of the block portion can align with a bolt hole of the bracket. A bolt then extends transversely through the bolt holes to secure the bracket to the anchor. Embodiments also include a support arm that, in the absence of a support beam, engages with the anchor and with a rear surface of the exterior layer. Embodiments also include a dual-anchor bracket system.

Disclosed herein is a bracket system for coupling to a wall, the wall including exterior layer and a support beam, the bracket system including, an anchor having, a flange extending over a frontal plane, parallel with a surface of the wall and defining a front surface and a rear surface, a stud portion extending from the rear surface of the flange and defining a stud-engaging surface configured to extend through the exterior layer and engage the support beam, and a block portion extending from the front surface of the flange, and a bracket having, a base defining a socket configured to slidably engage the block portion and secured thereto.

In some embodiments, the bracket system further includes an anchor screw hole extending longitudinally between a front surface of the anchor and the stud-engaging surface and including a countersunk portion communicating with the front surface of the anchor.

In some embodiments, the bracket system further includes a bolt hole extending transversely through a portion of the bracket and through the block portion, the bolt hole extending between a plane defined by the countersunk portion and a plane defined by the stud-engaging surface.

In some embodiments, the bracket system further includes a post extending along a longitudinal axis and including a retaining structure disposed at a front end of the post, the retaining structure defining a recess extending along a lateral axis.

In some embodiments, the recess is configured to receive a portion of a towel rod therein.

In some embodiments, a rear surface of the base includes a flange recess defining a diameter and a thickness equal to, or slightly larger than, a flange diameter and thickness, respectively, and configured to slidably engage the flange when the bracket is engaged with the anchor.

In some embodiments, the block portion defines a rectangular cross-sectional shape along a frontal plane, and the stud portion defines a circular cross-sectional shape along the frontal plane.

In some embodiments, the bracket system further includes one or both of a spike structure and a rim, the spike structure extending rearwards from a center point of the stud-engaging surface, and the rim extending rearwards from a perimeter of the stud-engaging surface, each of the spike structure and the rim configured to indent a front surface of the wall.

In some embodiments, the bracket system further includes a jig system, including one or more footings having a body defining a block portion aperture and a channel, the block portion aperture extending longitudinally and configured to slidably engage the block portion of the anchor, and the channel extending along a lateral axis.

In some embodiments, the bracket system further includes a bar defining an outer diameter that is equal to, or slightly smaller than, an inner diameter of the channel of the footing and configured to slidably engage the channel.

In some embodiments, the footing further includes a support screw slot extending longitudinally and configured to align with a support screw aperture extending through the flange when the block portion is engaged with the block portion aperture of the footing.

Also disclosed is a method of attaching a bracket system to a wall having an exterior layer supported by a support beam, the method including, extending a stud portion of an anchor through the exterior layer to contact the support beam, extending an anchor screw through the anchor to secure the anchor to the support beam, slidably engaging a socket of a bracket with a block portion of the anchor, and threadedly engaging a bolt through a portion of the base and through the block portion of the anchor between a plane defined by the anchor screw head and a surface of the support beam.

In some embodiments, the anchor further includes a flange extending along a frontal plane between the stud portion and the block portion, a rear surface of the flange engaging a front surface of the exterior layer of the wall.

In some embodiments, the method further includes aligning a transverse axis of the anchor with a vertical axis and securing the anchor in place using a support screw extending through the flange.

In some embodiments, the stud portion defines a circular cross-sectional shape and the block portion defines a rectangular cross-sectional shape.

In some embodiments, the method further includes aligning a stud-engaging surface of the stud portion with a front surface of the exterior layer and with a vertical center line of the support beam, and pressing the anchor against the exterior layer, and indenting the exterior layer using one or both of a spike and a rim extending from the stud-engaging surface to indicate a position to form a hole through which the stud portion extends to contact the support beam.

In some embodiments, the method further includes engaging a first footing of a jig system with the block portion of a first anchor, engaging a block portion of a second anchor with a second footing, slidably engaging the first footing and the second footing with a bar, sliding the second footing relative to the first footing along a lateral axis, and aligning the second anchor with a second support beam.

In some embodiments, one or both of the first footing and the second footing includes a block portion aperture extending between a front surface and a rear surface and slidably engaging the block portion.

In some embodiments, the method further includes securing the first footing to the first anchor by extending a support screw through a support screw slot and through a support screw aperture disposed in a flange of the anchor.

In some embodiments, the method further includes engaging a rod between a retaining structure of the first bracket and a retaining structure of the second bracket to form a towel rail.

Also disclosed is a dual anchor bracket system for coupling to a wall having an exterior layer and a support beam, the bracket system including, a first anchor including a first flange, a first stud portion extending from a rear surface of the first flange, and a first block portion extending from the front surface of the first flange, a second anchor including a second flange, a second stud portion extending from the rear surface of the second flange, and a second block portion extending from the front surface of the second flange, a support flange extending between the first flange and the second flange, a first bracket configured to engage the first block portion, a second bracket configured to engage the second block portion, and a rod configured to engage one or both of the first bracket and the second bracket.

In some embodiments, the first anchor, the second anchor, and the support flange are formed integrally as a single monolithic structure.

In some embodiments, the first bracket includes a first receiving structure having a first recess extending along a transverse axis and a lateral axis, and wherein the second bracket includes a second receiving structure having a second recess extending along a transverse axis and a lateral axis.

In some embodiments, the first recess is configured to retain a first end of the rod, and the second recess is configured to retain a second end of the rod.

In some embodiments, one or more of the first recess, the second recess, the first end, and the second end of the rod a includes a magnetic element configured to releasably retain the first end of the rod within the first receiving structure or the second end of the rod within the second receiving structure.

In some embodiments, one or more of the first recess, the second recess, the first end of the rod, and the second end of the rod a includes a bolt threadedly engaged therewith and configured to adjust a lateral distance between the magnetic element and the rod.

In some embodiments, one or more of the first recess, the second recess, the first end of the rod, and the second end of the rod a includes interference fit, press-fit, snap-fit, protrusion, detent, pawl, abutment, clip, or latch configured to releasably retain the rod.

In some embodiments, one or both of the first anchor and the second anchor includes a notch communicating between a flange recess and an outer perimeter and configured to receive a portion of the support flange therein.

Also disclosed is a method of attaching a bracket system to a wall including, extending a stud portion of an anchor and a support arm assembly through a hole in an exterior layer of the wall, the anchor slidably engaged at a first end of an anchor screw, and the support arm threadedly engaged with a second end of the anchor screw, engaging a first end of the support arm with a rear surface of the exterior layer at a first side of the hole, and engaging a second end of the support arm with a rear surface of the exterior layer at a second side of the hole, opposite the first side, rotating the anchor screw to compress a rear-most surface of the anchor against a surface of the support arm, and compressing a portion of the exterior layer between a front surface of the support arm and a rear surface of a flange of the anchor.

In some embodiments, the method further includes slidably engaging a socket of a bracket with a block portion of the anchor, and threadedly engaging a bolt through a portion of a base of the bracket and through the block portion of the anchor.

In some embodiments, the bracket includes a post that is rotatably engaged with the base.

In some embodiments, the anchor screw engages the support arm adjacent the first end of the support arm.

In some embodiments, the flange extends along a frontal plane between the stud portion and the block portion, the stud portion defines a circular cross-sectional shape and the block portion defines a rectangular cross-sectional shape.

In some embodiments, a width of the support arm is equal to or greater than a diameter of the stud portion and less than a diameter of the flange.

In some embodiments, a front surface of the support arm includes a wall engaging surface and a recess surface, the recess surface extending parallel to the wall engaging surface and configured to engage the rear-most surface of the anchor, the wall engaging surface disposed frontwards of the recess surface.

DRAWINGS

A more particular description of the present disclosure will be rendered by reference to specific embodiments thereof that are illustrated in the appended drawings. It is appreciated that these drawings depict only typical embodiments of the invention and are therefore not to be considered limiting of its scope. Example embodiments of the invention will be described and explained with additional specificity and detail through the use of the accompanying drawings in which.

DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein. It is understood that the drawings are diagrammatic and schematic representations of exemplary embodiments of the invention, and are neither limiting nor necessarily drawn to scale.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise. Also, the words "including," "has," and "having," as used herein, including the claims, shall have the same meaning as the word "comprising."

In the following description, the terms "or" and "and/or" as used herein are to be interpreted as inclusive or meaning any one or any combination. As an example, "A, B or C" or "A, B and/or C" mean "any of the following, A, B, C, A and B, A and C, B and C, A, B and C." An exception to this definition will occur only when a combination of elements, components, functions, steps or acts are in some way inherently mutually exclusive.

Figure 1:
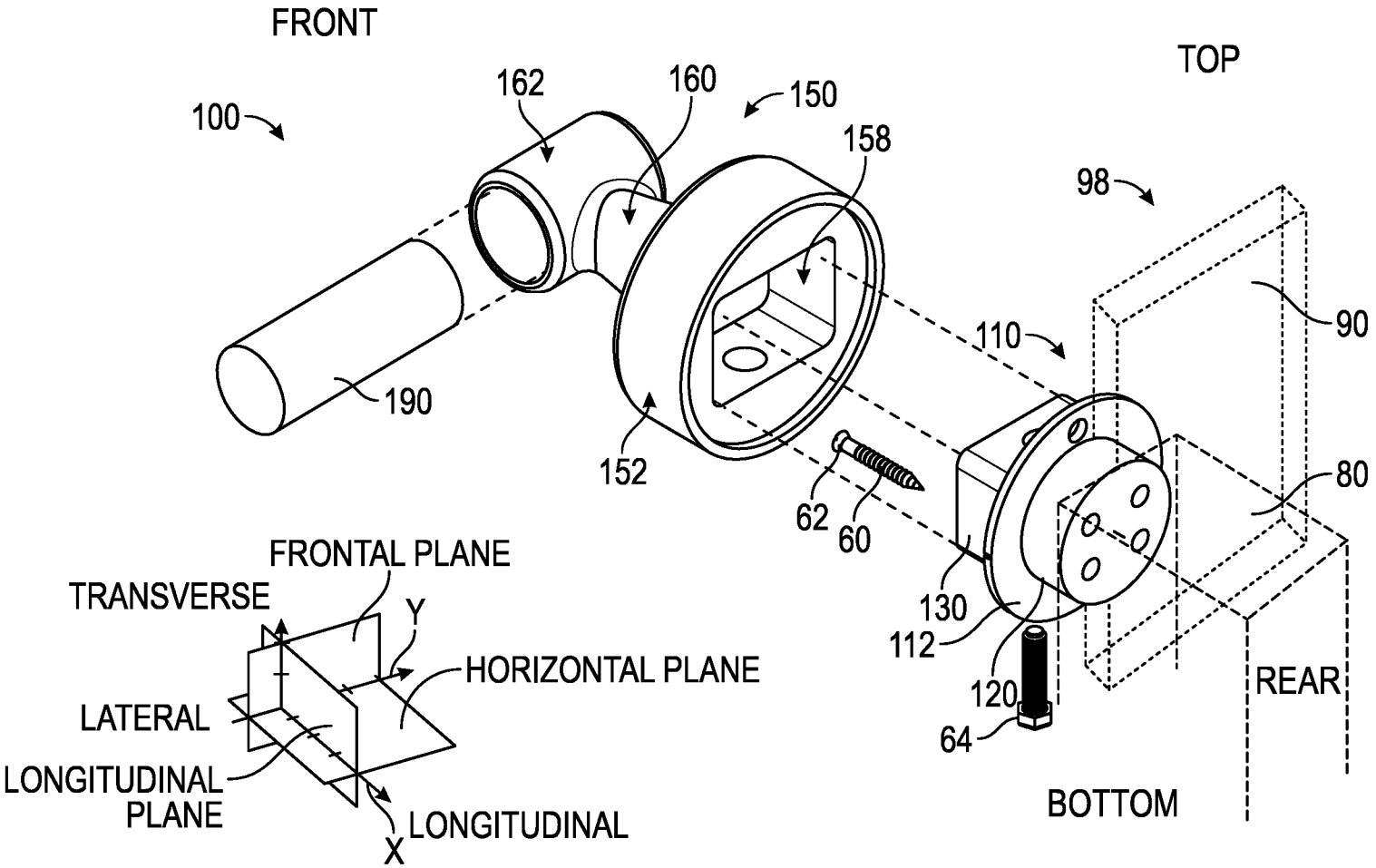
FIG. 1 shows an exploded rear-side view of a bracket system including an anchor and a bracket, in accordance with embodiments disclosed herein.

To assist in the description of embodiments described herein, and as shown in FIG. 1, a longitudinal axis extends between the front side and the rear side of the bracket system. A lateral axis extends normal to the longitudinal axis between the left side and the right side of the bracket system, and a transverse axis extends normal to both the longitudinal and lateral axes between a top side and a bottom side. A frontal plane is defined by the lateral and transverse axes. A horizontal plane is defined by the lateral and longitudinal axes. A longitudinal plane is defined by the longitudinal and transverse axes.

Unless defined otherwise, all technical and scientific terms used herein have the same meaning as commonly understood by those of ordinary skill in the art.

FIG. 1 shows a bracket system ("system") 100 configured to be secured to a wall and generally including an anchor 110 and a bracket 150. Optionally, the system 100 can further include a rod 190, ring 390, or similar structure coupled to the bracket, as described in more detail herein. As shown in FIG. 1, the system 100 is shown in exploded perspective view from a rear side, where a rear side of the system 100 engages a wall 98. An exterior layer 90 and a supporting beam 80 of the wall 98 are shown in cut-away, wire frame for ease of explanation.

In an embodiment, the anchor 110 includes a flange 112 extending over a frontal plane, a first portion, or stud portion 120 extending rearwards from the flange 112, and a second portion, or block portion 130, extending frontwards from the flange 112. In an embodiment, the stud portion 120 is configured to extend through an exterior layer 90 of the wall 98, e.g. a drywall layer, or the like, and engages directly with a stud or similar supporting beam 80 disposed behind the exterior layer 90. The bracket 150 then engages a block portion 130 of the anchor 110, opposite the stud portion 120, and is securely coupled thereto. Optionally, the bracket 150 further engages a rod 190, ring 390, or similar structure, as described in more detail herein.

Advantageously, the bracket system 100 can support a towel rod, towel ring, handle, shelving support, picture hanger, TV mount, exercise equipment, pull-up bar, shower curtain rods, drapes, or similar structures for supporting, attaching, and/or suspending structures and/or utensils (e.g. towels etc.) from the wall. Further, since the bracket system 100 extends through the exterior layer 90 to engage directed with a supporting beam 80, the bracket system 100 can support an increased weight and mitigate the system 100 from being forcibly removed from the wall 98 should additional weight been added. For example, where brackets are attached to an exterior layer of drywall using conventional screws, rawl plugs, etc., the load capacity is limited by the strength of the drywall localized to the area of dry wall, e.g. approximately 50 lbs. Where brackets are attached to a front surface of the drywall exterior layer 90 and to the supporting beam 80 behind, greater load capacities can be achieved. However, load capacities are still limited since the bracket is resting on a relatively small surface area of the exterior layer of drywall, which can be compressed and crushed leading to failure of the bracket system. Advantageously, embodiments of the bracket system 100 disclosed herein extends through the surface drywall layer 90 to engage directly with the supporting beam 80 and, as such, can support greater load capacities.

Figure 2B:
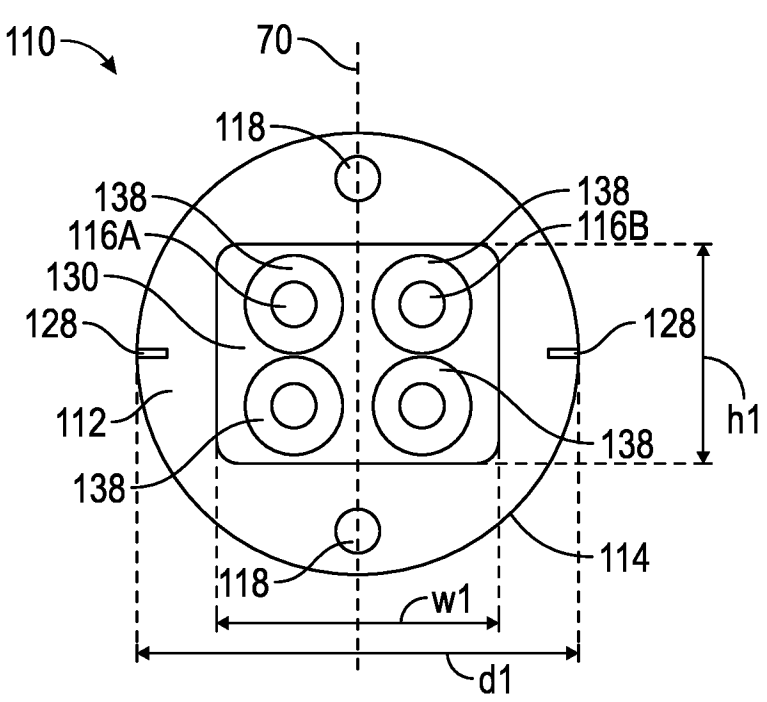
FIG. 2B shows a front view of an anchor, in accordance with embodiments disclosed herein.
Figure 2A:
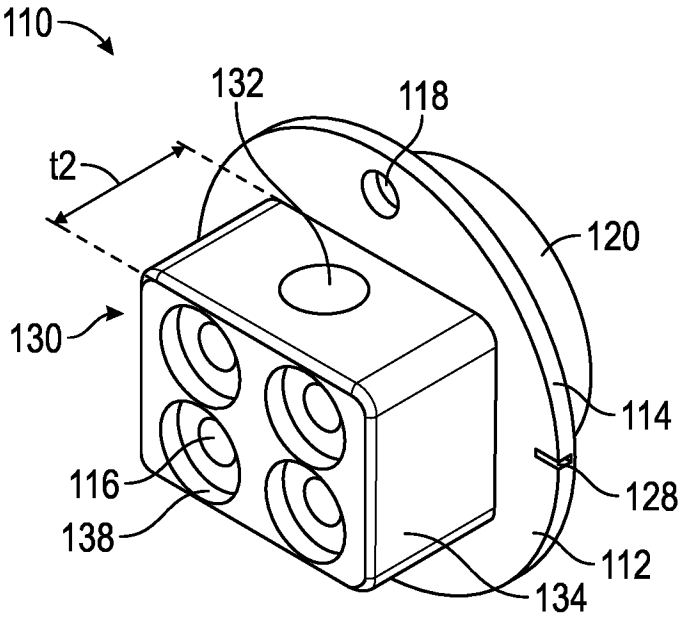
FIG. 2A shows a perspective front view of an anchor, in accordance with embodiments disclosed herein.
Figure 2D:
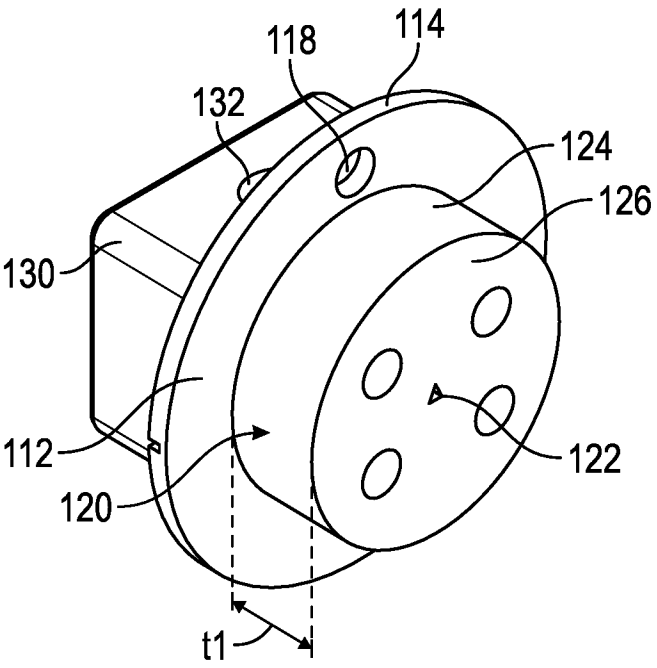
FIG. 2D shows a perspective rear view of an anchor, in accordance with embodiments disclosed herein.
Figure 2C:
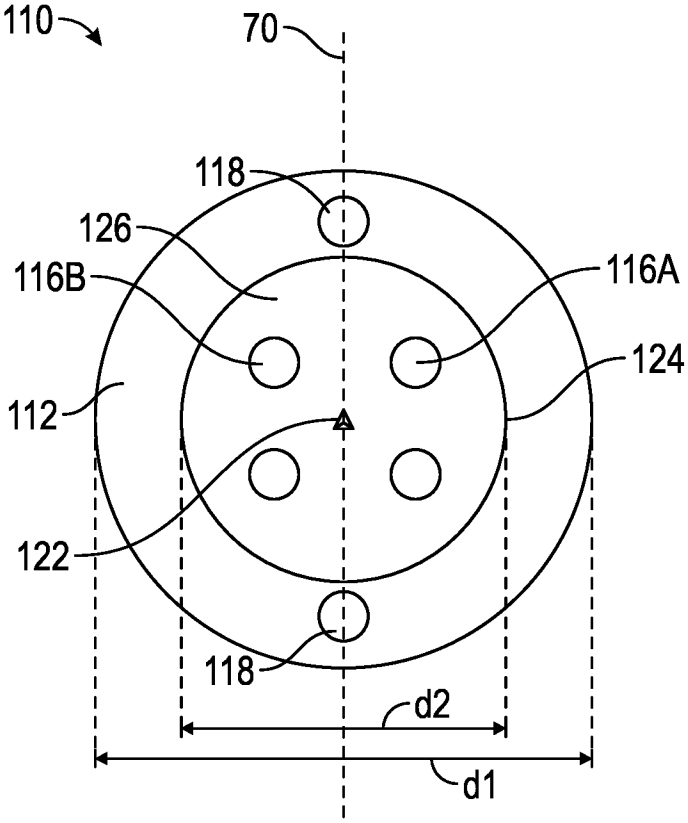
FIG. 2C shows a rear view of an anchor, in accordance with embodiments disclosed herein.

FIGS. 2A-2D show various views of the anchor 110 of the system 100. FIG. 2A shows a front-side perspective view of the anchor. FIG. 2B shows a front side view, and FIG. 2C shows a rear side view. FIG. 2D shows a perspective rear-side view of the anchor 110. The anchor 110 includes a flange 112 extending over a frontal plane and defining an outer perimeter 114. As shown, the outer perimeter 114 defines a substantially circular shape, however it will be appreciated that other regular or irregular, closed curve shapes are also contemplated. In an embodiment, the flange 112 defines a first diameter (d1) of between 1 inch. and 4 inch. However, it will be appreciated that greater or lesser diameters of the first diameter (d1) are also contemplated. In an embodiment, the first diameter (d1) is 2.3 inch.

The anchor 110 further includes a stud portion 120 extending rearwards from a rear side of the flange 112, and a block portion 130 extending frontwards from a front surface of the flange 112. In an embodiment, the stud portion 120 defines a substantially circular outer perimeter 124, however it will be appreciated that other regular or irregular, closed curve perimeter shapes are also contemplated. In an embodiment, the outer perimeter 124 of the stud portion 120 defines a second diameter (d2) that is less than the first diameter (d1). In an embodiment, the second diameter (d2) is between 0.5 inch. and 3 inch. However, it will be appreciated that greater or lesser diameters of the second diameter (d2) are also contemplated. In an embodiment, the second diameter (d2) is 1.5 inch.

In an embodiment, as shown in FIG. 2D, the stud portion 120 defines a first thickness (t1). As used herein, the first thickness (t1) is defined as a distance between a rear-most surface of the stud portion 120 and a rear-most surface of the flange 112. In an embodiment, the first thickness (t1) is between 0.25 inch. and 1 inch. However, it will be appreciated that greater or lesser thicknesses are also contemplated. In an embodiment, the first thickness (t1) is 0.5 inch. In an embodiment, the first thickness (t1) is substantially equal to a thickness of the exterior layer 90 of the wall 98.

In an embodiment, the block portion 130 defines a substantially rectangular outer perimeter 134, however it will be appreciated that other regular or irregular, closed curve perimeter shapes are also contemplated, such as square, hexagonal, circular, oval, elliptical, or the like. In an embodiment, the outer perimeter 134 of the block portion 130 defines a first width (w1) and a first height (h1). In an embodiment, one or both of the first width (w1) and the first height (h1) is between 0.5 inch. and 3 inch. However, it will be appreciated that greater or lesser widths and/or heights are also contemplated. In an embodiment, the first width (w1) is 1.48 inch, and the first height (h1) is 1.13 inch.

In an embodiment, as shown in FIG. 2A, the block portion 130 defines a second thickness (t2). As used herein, the second thickness (t2) is defined as a distance between a front-most surface of the block portion 130 and a front-most surface of the flange 112. In an embodiment, the second thickness (t2) is between 0.25 inch. and 1 inch. However, it will be appreciated that greater or lesser thicknesses are also contemplated. In an embodiment, the second thickness (t2) is 0.8 inch.

In an embodiment, the anchor 110 includes one or more anchor screw-holes 116 extending along a longitudinal axis between a front surface through to the rear surface of the anchor 110, e.g. between a front surface of the block portion 130 and a rear surface of the stud portion 120. As shown, the anchor 110 includes four anchor screw-holes 116, however, greater or lesser numbers of anchor screw-holes 116 are also contemplated. In an embodiment, the anchor 110 includes at least a first anchor screw-hole 116A disposed on a first side of a central vertical axis 70 and at least a second anchor screw-hole 116B disposed on a second side of a central vertical axis 70, opposite the first side. In an embodiment, one or more anchor screw-holes 116 include a countersunk portion 138 at a front end of the anchor screw-holes 116 and configured to receive a screw head 62 of the anchor screw 60 therein. Exemplary anchor screws can include RSS 10 screws, however, it will be a appreciated that this is not intended to be limiting and that other screws, or similar suitable fastenings, are also contemplated. A longitudinal depth of the countersunk portion 138 is equal to or greater than a longitudinal height of the anchor screw head 62. Advantageously, the countersunk portion 138 mitigates the anchor screw 60 from abutting against a portion of the bracket 150, when the bracket engages the anchor 110, as described in more detail herein.

In an embodiment, the block portion 130 further includes a bolt hole 132 extending along a transverse axis between a bottom side of the block portion 130 and a top side of the block portion 130. An inner diameter of the bolt hole 132 is equal to or greater than an outer diameter of a bolt 64 extending therethrough. In an embodiment, the bolt hole 132 includes a diameter equal to or slightly less than an outer diameter of the bolt 64, and includes a threaded engagement configured to engage the threaded engagement of the bolt 64 In an embodiment, the bolt hole 132 extends along an axis disposed between a frontal plane defined by a countersunk portion 138 of the anchor screw-hole 116, and a frontal plane defined by a rear-most surface of the anchor 110. In an embodiment, the bolt hole 132 extends along an axis disposed between a frontal plane defined by a countersunk portion 138 of the anchor screw-hole 116, and a frontal plane defined by a front surface of the flange 112.

It is important to note that the bolt 64 extending through the bolt hole 132 extends between two or more anchor screws 60 extending through the anchor screw-holes 116. As such the fasteners of the bolt 64 and anchor screw 60 interlock providing increased strength to the system 100. The interlocking configuration of the fasteners allows the portions of the anchor 110 disposed therebetween to also rely on compressive strength, sheer strength, and torsional strength, in addition to the tensile strength of the material of the anchor 110. Further, the diameter (d1) of the flange 112 provides an increased surface area supported against an outer surface of the exterior layer 90 and, as such, increases the stability of the bracket system 100 and mitigates failure under increased loading.

In an embodiment, the flange 112 includes one or more guide notches 128, markings, alphanumeric symbols, or the like disposed along an edge of the flange 112 and on a front surface thereof. The guide notches 128 can be positioned along the edge of the flange 112 to indicate one or more measurements. For example, one or more guide notches 128 can be positioned at a 90° and a 270° position about the central longitudinal axis to indicate a lateral axis or horizontal plane. Similarly, one or more guide notches 128 can be positioned at a 0° and a 180° position about the central longitudinal axis to indicate a transverse axis or longitudinal plane. As will be appreciated, other guide notches 128 can be positioned at other angles about the longitudinal axis of between 1° and 360°. Advantageously, the guide notches 128 can facilitate aligning the anchor 110 with various guide marks, plumb lines, or the like.

Figure 3B:
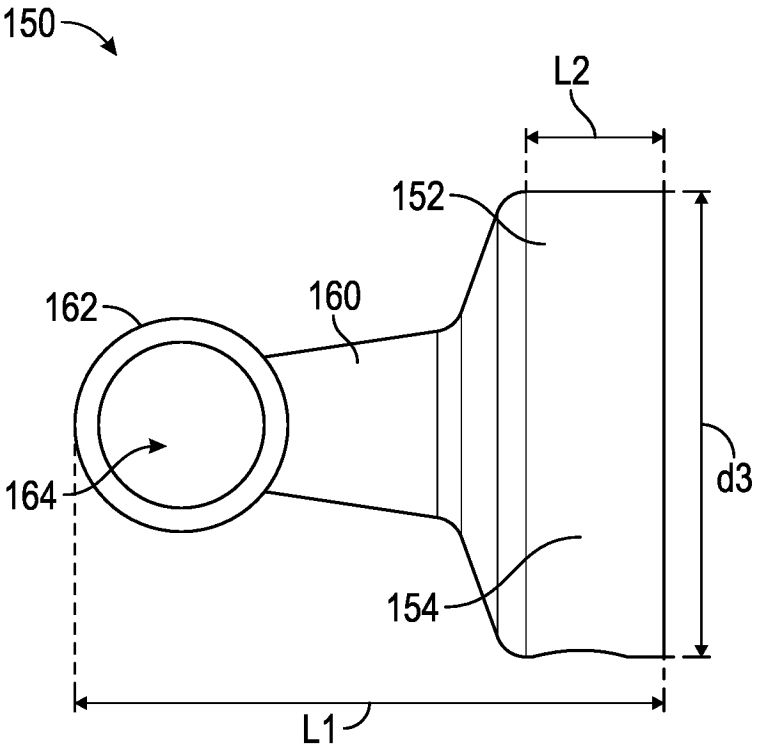
FIG. 3B shows a side view of a bracket, in accordance with embodiments disclosed herein.
Figure 3A:
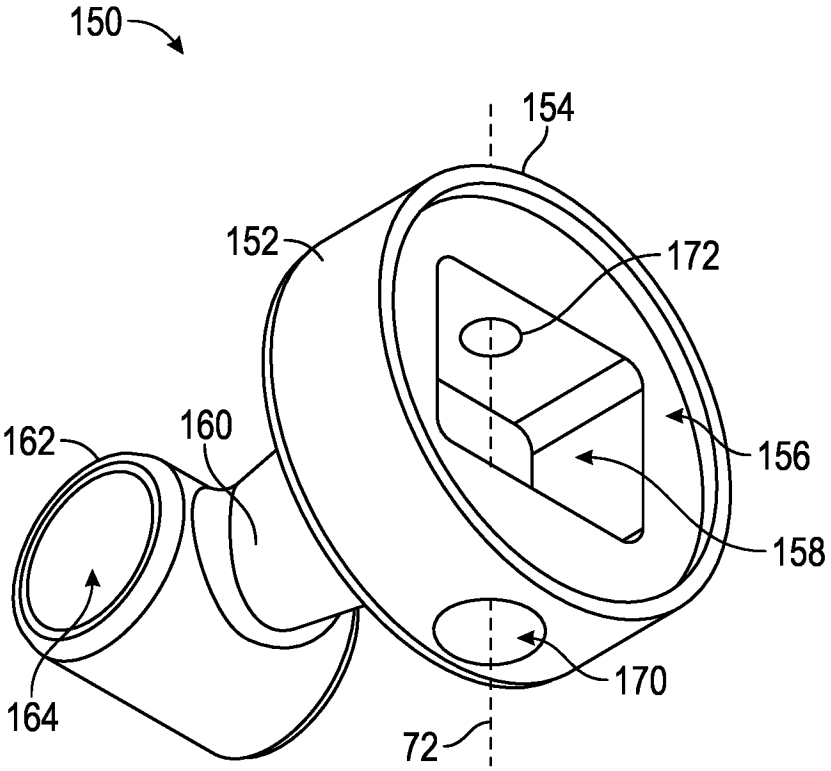
FIG. 3A shows a perspective rear view of a bracket, in accordance with embodiments disclosed herein.
Figure 3D:
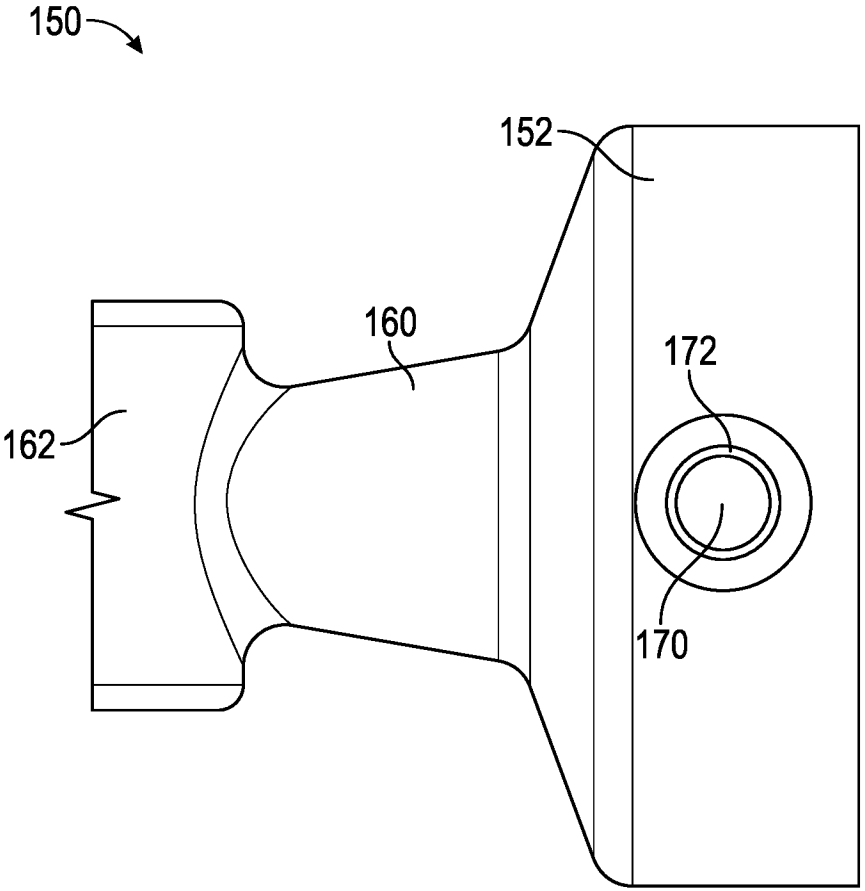
FIG. 3D shows an underside view of a bracket, in accordance with embodiments disclosed herein.
Figure 3C:
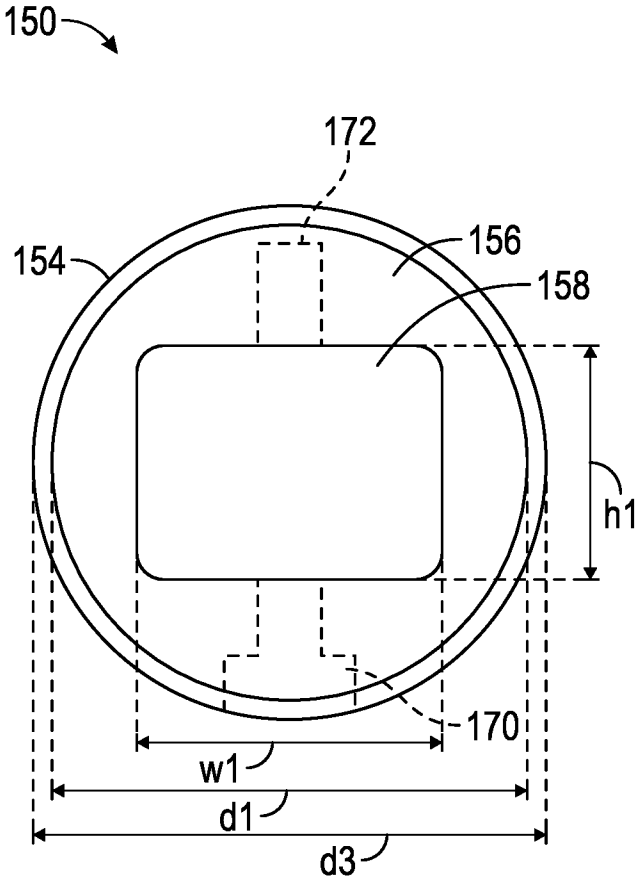
FIG. 3C shows a rear view of a bracket, in accordance with embodiments disclosed herein.
Figure 5B:
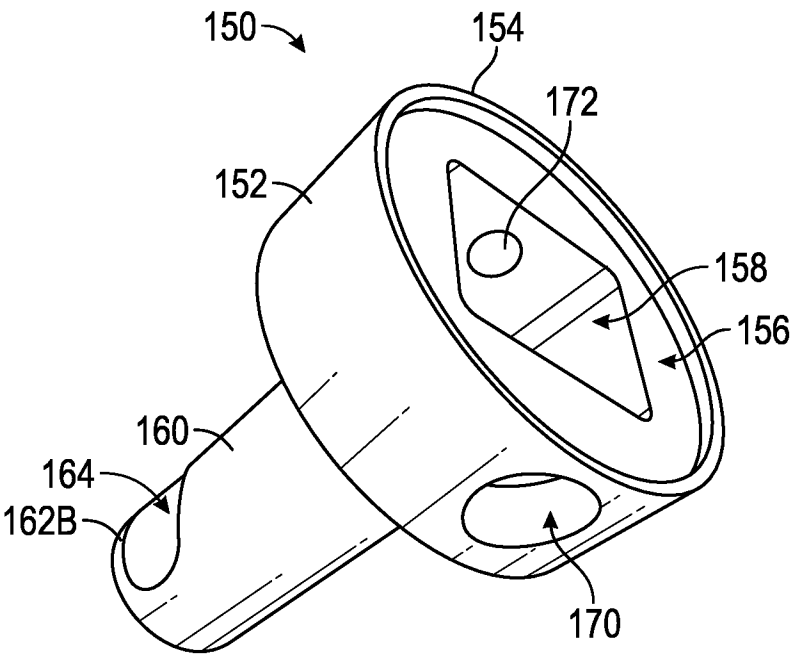
FIG. 5B shows an underside perspective view of a bracket, in accordance with embodiments disclosed herein.
Figure 5A:
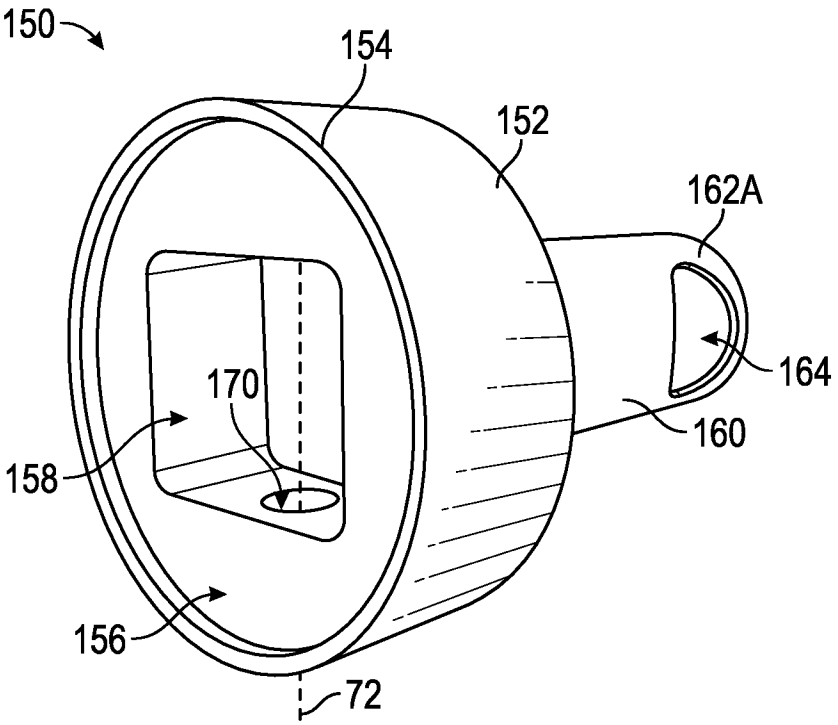
FIG. 5A shows a rear perspective view of a bracket, in accordance with embodiments disclosed herein.
Figure 6A:
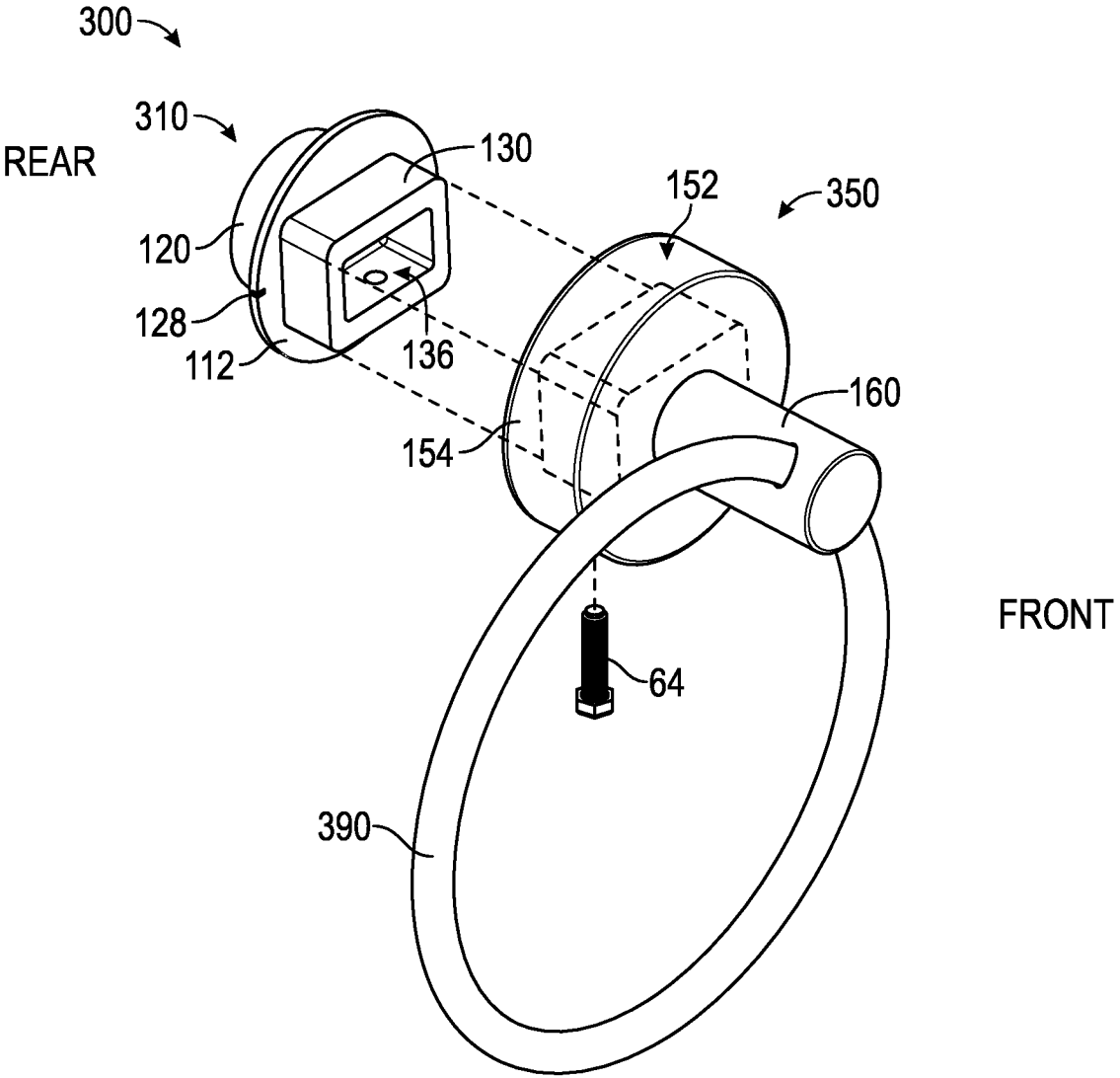
FIG. 6A shows an exploded front-side view of a ring bracket system including an anchor and a ring bracket, in accordance with embodiments disclosed herein.
Figure 6B:
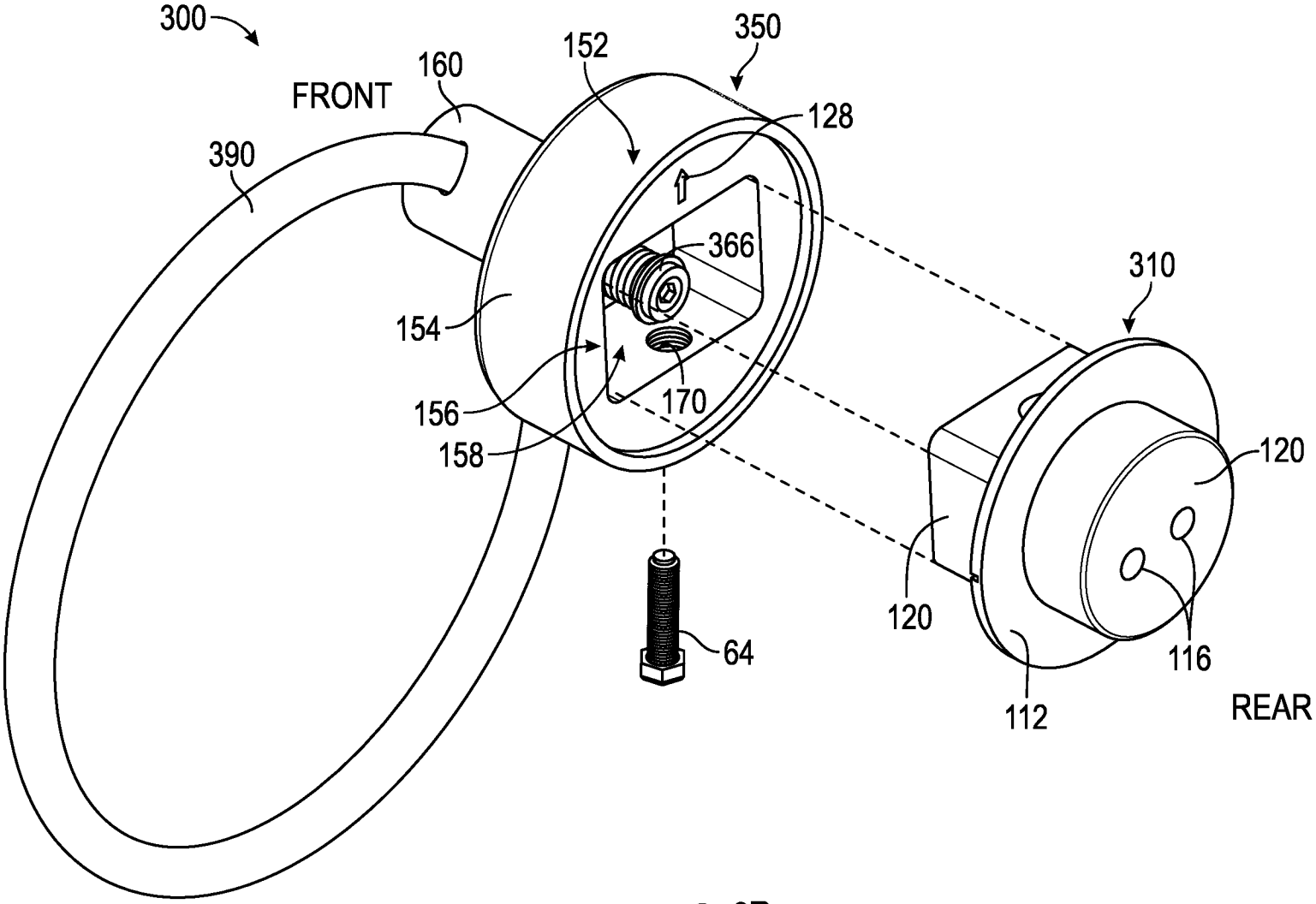
FIG. 6B shows an exploded rear-side view of a ring bracket system including an anchor and a ring bracket, in accordance with embodiments disclosed herein.
Figure 6D:
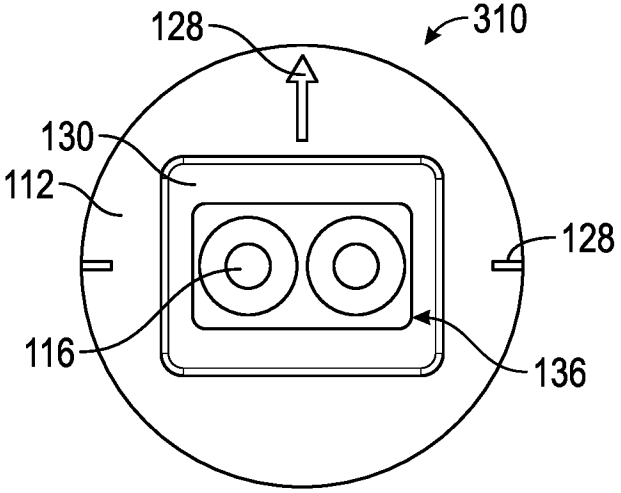
FIG. 6D shows a front-side view of an anchor of the ring bracket system of FIG. 6A, in accordance with embodiments disclosed herein.
Figure 6C:
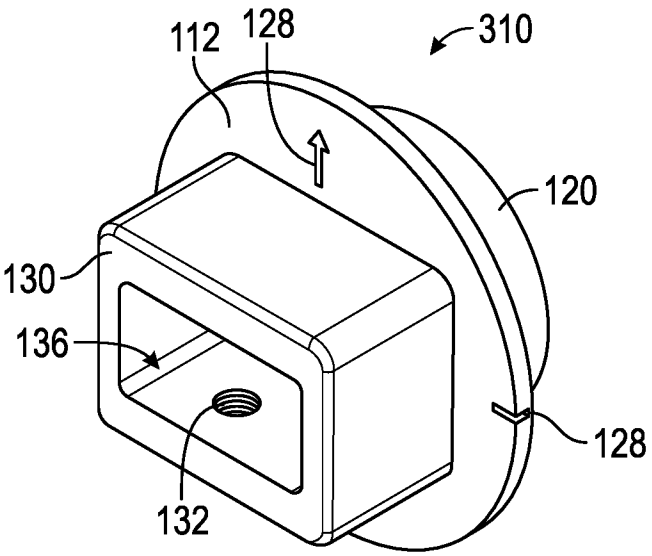
FIG. 6C shows a front-side perspective view of an anchor of the ring bracket system of FIG. 6A, in accordance with embodiments disclosed herein.

FIGS. 3A-3D and 5A-5B shows various views of a bracket 150. FIG. 3A shows a perspective, rear-side view of the bracket 150. FIG. 3B shows a lateral-side view. FIG. 3C shows a rear-side view of the bracket 150. FIG. 3D shows a bottom-side view. FIG. 5A shows a rear perspective view. FIG. 5B shows an underside perspective view. The bracket 150 generally includes a base 152 disposed rearwards and includes a post 160 extending forwards therefrom, along a longitudinal axis. In an embodiment, the post 160 includes a retaining structure 162 disposed at a front-side end of the post 160, opposite from the base 152, and configured to receive a portion of a rod, a ring, or similar structure, therein.

In an embodiment, as shown in FIGS. 1, 3A-3B, and 5A-5B, the retaining structure 162 defines a substantially cylindrical recess 164 configured to receive an end portion of a rod 190 such as a towel rod, handle, or the like. In an embodiment, a central axis of the recess 164 extends along a lateral axis, however, it will be appreciated that the central axis of the recess 164 can also extend along other axes, or at angles thereto, without limitation. An end portion of the rod 190 extends into the recess 164 and abuts against an end wall of the recess 164. In an embodiment, as shown in FIGS. 5A-5B, a second bracket system 100 secures an opposite end of the rod 190, in like manner, to secure the rod 190 in place for use as a towel rail, handle, or the like, as described in more detail herein. In an embodiment, the user can trim the rod 190 to a preferred length and position the rod 190 between a first bracket system and a second bracket system, as described in more detail herein.

In an embodiment, a cross-sectional shape of the recess 164 (longitudinal plane) defines a circular shape, however it will be appreciated that other regular or irregular, closed curve shapes are also contemplated such as elliptical, oval, square, rectangular, hexagonal, or the like. In an embodiment, as shown in FIG. 3B, the bracket 150 extends along a longitudinal axis by a first length (L1). In an embodiment, the first length (L1) extends between 1 inch. and 10 inch. In an embodiment, the first length (L1) extends between 3 inch. and 4 inch. However, it will be appreciated that greater or lesser lengths are contemplated.

In an embodiment, the base 152 extends over a frontal plane and defines an outer perimeter 154. In an embodiment, the outer perimeter 154 defines a circular shape (frontal plane). However, it will be appreciated that other regular or irregular, closed curve shapes are also contemplated such as elliptical, oval, square, rectangular, hexagonal, or the like. In an embodiment, the outer perimeter 154 of the base 152 defines a third diameter (d3) that is equal to, or larger than, the first diameter (d1) of the flange 112. In an embodiment, the third diameter (d3) extends between 2 inch. and 5 inch. In an embodiment, the third diameter (d3) extends 2.5 inch. However, it will be appreciated that greater or lesser diameters are contemplated.

In an embodiment, a rear surface of the base 152 defines a flange recess 156 configured to receive the flange 112, or a portion thereof, therein. As such, the flange recess 156 defines a similar shape matching that of the outer perimeter 114 of the flange 112, e.g. a circular shape. A diameter of the flange recess 156 is equal to, or slightly larger than, the first diameter (d1) of the flange 112, such that the flange 112 can slidably engage the flange recess 156 along the longitudinal axis. Similarly, a depth of the flange recess 156, extending over the longitudinal axis is equal to, or slightly larger than, a thickness of the flange 112. As such, with the anchor 110 engaged with the bracket 150, a rear surface of the flange 112 aligns with a rear surface of the bracket 150.

In an embodiment, a rear surface of the base 152 further includes a socket 158 configured to receive the block portion 130 of the anchor 110 therein. As such, the socket 158 defines a similar shape matching that of the outer perimeter 134 of the block portion 130, e.g. a substantially rectangular shape. A width and height of the socket 158 can be equal to or slightly larger than the first width (w1) and first height (h1) of the block portion 130, respectively, such that the block portion 130 slidably engages the socket 158 along the longitudinal axis. Similarly, a depth of the socket 158, extending over the longitudinal axis, is equal to, or slightly larger than, a second thickness (t2) of the block portion 130. As such, the block portion 130 fits securely within the socket 158 with little to no space therebetween. Advantageously, the shape of the block portion 130 and the corresponding shape of the socket 158 prevents rotational movement of the bracket 150, relative to the anchor 110, about the longitudinal axis. Similarly, a depth of the socket 158 relative to the second thickness (t2) of the block portion 130 mitigates rotational movement of the bracket 130, relative to the anchor 110, through the longitudinal plane.

In an embodiment, the outer perimeter 154 of the base 152 extends over the longitudinal axis by a second length (L2) to define an outer side wall. In an embodiment, the base 152 includes a bolt hole 170 extending along an axis perpendicular to the longitudinal axis and configured to align with the bolt hole 132 of the block portion 130. As shown, the bolt hole(s) 132, 170 extend along the transverse axis, however, it will be appreciated that the bolt holes 132, 170 can also extend along a lateral axis, or along an axis extending at an angle there between. An axis 72 of the bolt hole 170 of the bracket 150 extends through a longitudinal mid-point of the socket 158 and aligns with the bolt hole 132 of the block portion 130 when the anchor 110 is engaged with the bracket 150. The bracket bolt hole 170 extends from an entrance disposed on the outer perimeter 154 of the base 152, through the socket 158 to a point that is on an opposite side of the socket 158 from the entrance. A diameter of the bolt hole 170 is equal to, slightly less than, or slightly larger than, a diameter of a shaft of a bolt 64 and includes a threaded portion 172. The threaded portion 172 can be disposed at an opposite end of the bolt hole 170 from the entrance and configured to engage a threaded portion of the bolt 64.

In an embodiment, an entrance of the bolt hole 170 communicates with the outer perimeter 154 of the base 152 and includes a countersunk portion that defines a diameter that is equal to or larger than a bolt head of the bolt 64 to receive the bolt head therein. In an embodiment, the bracket bolt hole 170 extends from an entrance at a bottom surface and extends vertically upwards through the socket 158 to a threaded portion 172 disposed in a top surface of the socket 158. In an embodiment, an entire length of the bolt hole 170 is threaded. When the block portion 130 is fully engaged with the socket 158, the bolt hole 132 of the block portion 130 aligns with the bolt hole 170 of the bracket 150. The bolt 64 then extends through both the anchor bolt hole 132 and the bracket bolt hole 170 to secure the bracket 150 to the anchor 110 in a threaded engagement. As noted, the bolt 64 can interlock between the anchor-screws 116 to provide improved strength.

In an embodiment, as shown in FIGS. 4A-4D, the system 100 further includes an installation jig system ("jig") 200 configured to align a first bracket system 100A with a second bracket system 100B. The jig 200 includes a first footing 210A and a second footing 210B. Each of the first footing 210A and the second footing 210B slidably engages one or more bars 290, e.g. a first bar 290A and a second bar 290B. In an embodiment, the bar 290 includes an abutment 292 disposed at an end of the bar 290. In an embodiment, the abutment 292 is formed integrally with the bar 290. In an embodiment, the abutment 292 is releasably engages with the bar 290 in a friction fit, snap fit, threaded engagement, or similar suitable attachment mechanism. The abutment 292 is configured to prevent the footing 210 from disengaging the bar 290.

In an embodiment, the footing 210 includes a body 212 extending over a frontal plane and defining a front surface and a rear surface. The body 212 includes a block portion aperture 214. A width and height of the block portion aperture 214 is equal to or slightly larger than the first width (w1) and first height (h1) of the block portion 130, respectively, such that the block portion 130 slidably engages the block portion aperture 214. Similarly, a depth of the block portion aperture 214, extending over the longitudinal axis, is equal to, or slightly smaller than a second thickness (t2) of the block portion 130. As such, the block portion 130 fits securely within the block portion aperture 214 with little to no space therebetween and extends through the body 212 between a rear surface and a front surface of the footing 210.

In an embodiment, the footing 212 further includes one or more support screw slots 218. The support screw slot 218 extends through the body 212 between the front surface and the rear surface and extends along a lateral axis. The support screw slot 218 aligns with a support screw-hole 118 of the anchor 110 when the block portion 130 is engaged with the block portion aperture 214.

Figure 4A:
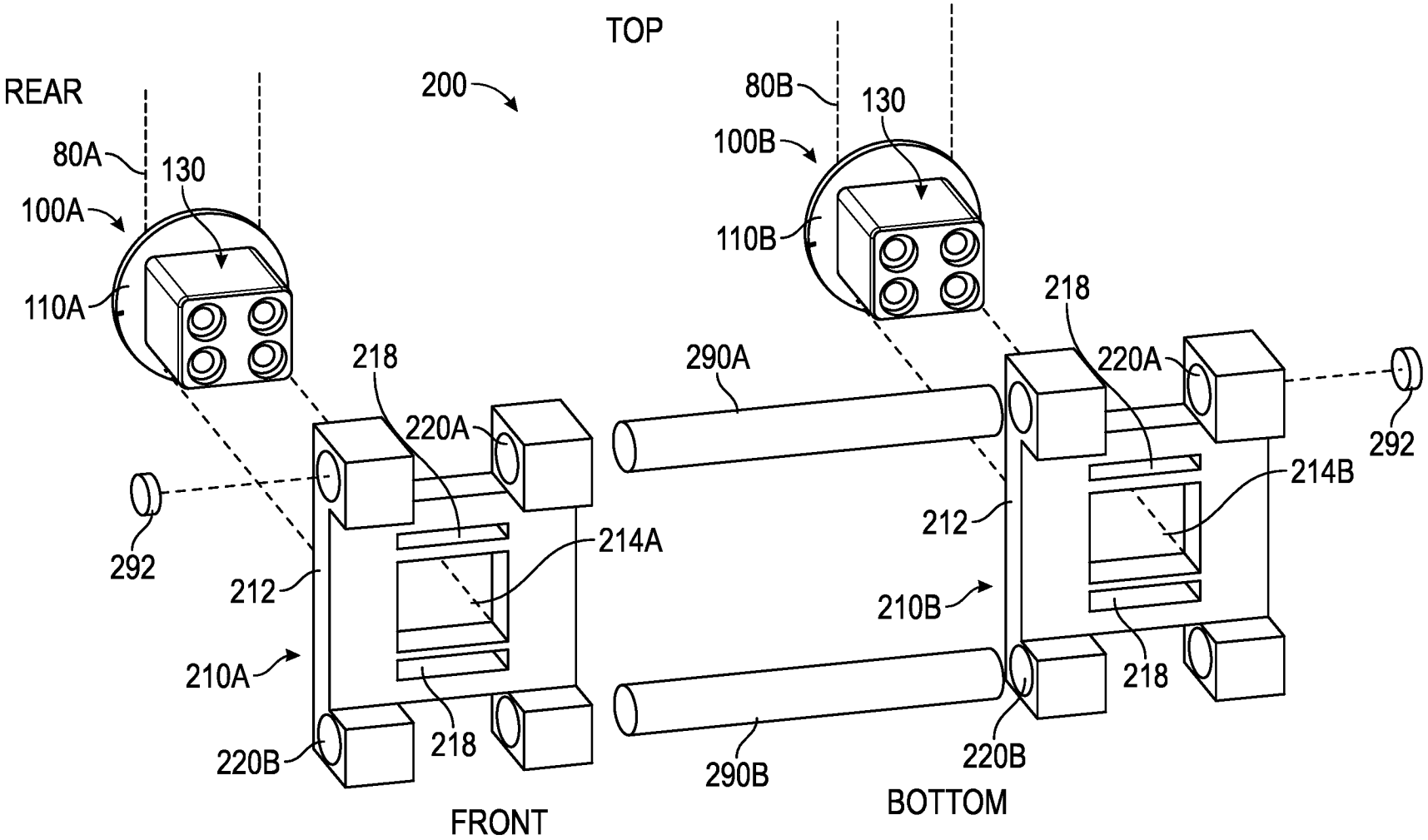
FIG. 4A shows an exploded view of a bracket and jig system, in accordance with embodiments disclosed herein.

In an embodiment, the footing 210 further includes one or more channels 220 extending along a lateral axis. An inner diameter of the channel 220 is equal to, or slightly larger than, an outer diameter of the bar 290. As such, the bar 290 slidably engages the channel 220 of the footing 210. As shown in FIG. 4A, each footing 210 includes a top channel 220A and a bottom channel 220B. The top channel 220A is configured to receive a portion of the first bar 290A and the bottom channel 220B is configured to receive a portion of the second bar 290B. The channel 220 slidably engages the bar 290 to align the first footing 210A with a second footing 210B along a lateral axis. More specifically, the channel 220 slidably engages the bar 290 to align the first block portion aperture 214A of the first footing 210A with a first block portion aperture 214B of the second footing 210B along a lateral axis. Further the lateral distance between the first block portion aperture 214A and the second block portion aperture 214B can be modified as needed. In an embodiment, a lateral length of the bar 290 is between 10 inch. and 36 inch. In an embodiment, a lateral length of the bar 290 is 24 inch. However, it will be appreciated that greater or lesser lateral lengths of the bar 290 are also contemplated. As noted, the bar 290 includes an abutment 292 disposed at an end of the bar 290 and abut against the footing 210 to prevent the footing 210 from disengaging the bar 290.

In an embodiment, the bracket system 100, or portions thereof such as the anchor 110, bracket 150, rod 190, jig system 200, or combinations thereof, is formed from one or more materials. Exemplary materials can include plastics, polymers, metals, alloys, composites, or the like. In an embodiment, the bracket system 100, or portions thereof, is formed from a single monolithic piece. In an embodiment, the bracket system 100, or portions thereof, is formed from injection molding or similar molding techniques. In an embodiment, the bracket system 100, or portions thereof, is formed from 3D printing, or similar additive manufacturing techniques. In an embodiment, the bracket system 100, or portions thereof, is formed as a hollow, partially hollow, lattice structure, "honeycomb" structure, or the like.

In an exemplary method of use, a bracket system 100 including one or more of an anchor 110, a bracket 150, a rod 190 and a jig system 200 are provided, as described herein. In an embodiment, a user aligns the anchor 110, with a rear surface of the anchor 110 engaging a front surface of the wall 98, i.e. a front surface of an exterior layer 90 of the wall 98, e.g. a dry wall layer. More specifically, the rear surface of the anchor 110 is defined by a stud engaging surface 126 of the stud portion 120. Optionally, a user identifies a position of the support beam 80 behind the exterior layer 90 using a "stud finder" or similar suitable device. The user then aligns a center point of the stud engaging surface 126 with a central vertical (transverse) axis of the support beam 80.

As shown, the stud engaging surface 126 defines a substantially circular cross-sectional shape. In an embodiment, the stud engaging surface 126 includes a spike 122 extending from a center point of the circular, stud engaging surface 126. The user aligns the spike 122 with a central vertical axis of the support beam 80 to center the circular stud engaging surface 126 with the support beam 80 along a lateral axis. Alternatively, or in addition to, a user marks the lateral outer edges of the support beam 80 using a stud finder, or similar suitable means, and centers the lateral outer most edges of the stud engaging surface 126 therebetween along the lateral axis. As such, the spike 122 aligns with a central vertical axis of the support beam 70. With the spike 122 aligned as such, a user presses the anchor 110 against the exterior layer 90 of the wall 98, or tap the front surface of the anchor 110 with a hammer or the like, and the spike 122 forms a dent in the wall surface indicating a center point of the stud engaging surface 126. The user then uses the dent formed by the spike 122 as an indicator of where to align a hole saw, spade bit, or similar device configured to cut a hole through the exterior layer at the same diameter, or slightly larger than the second diameter (d2) of the stud portion 120.

In an embodiment, the stud engaging surface 126 includes a continuous or discontinuous rim (not shown), extending longitudinally and along an outer edge of the stud engaging surface 126. The rim extends from the stud engaging surface 126 by a similar longitudinal distance as the spike 122. When the user taps or presses the anchor 110 into wall surface, the rim indicates to a user an outer perimeter of the hole that is to be cut into the wall exterior layer 90.

With the hole cut in the exterior layer 90, the support beam 80 behind the exterior layer is exposed. The user then slides the stud portion 120 of the anchor 110 through the hole in the exterior layer 90 so that the stud engaging surface 126 contacts the surface of the support beam 80 directly. Alternatively, or in addition to, the user slides the stud portion 120 of the anchor 110 through the hole so that the rear surface of the flange 112 engages a front surface of the wall 98, i.e. a front surface of the exterior layer 90. Advantageously, the hole cut within the exterior layer 90 is sized to slidably engage the first portion 110 in an interference fit and holds the anchor 110 in place when engaged therewith.

Advantageously, the circular shape of the stud portion 120 allows the user to rotate the anchor 110 about the longitudinal axis until the vertical axis of the anchor 110 is correctly aligned, e.g. the transverse axis of the anchor 110 is aligned with the vertical axis of the support beam 80, or a plumb line, spirit level, etc. Worded differently, the anchor 110 can be rotated about the longitudinal axis until a top surface of the block portion 130 is aligned with a horizontal axis, e.g. using a spirit level or the like.

Once the anchor 110 is correctly aligned a user secures the anchor 110 in place by placing a screw through one or more of the support screw-hole(s) 118 and secures the anchor 110 in place, ensuring the anchor 110 does not further rotate about the longitudinal axis once correctly aligned. To note, the screws placed through the support screw-hole(s) 118 are relatively shorter and/or thinner, relative to the anchor screw 60. A user then places an anchor screw 60 through each of the anchor screw-holes 116 to secure the anchor 110 directly to the support beam 80. As shown, the anchor 110 includes four anchor screw-holes 116 and as such the user places four anchor screws 60, one through each anchor screw-hole 116 to secure the anchor 110 directly to the support beam 80. However, it will be appreciated that greater or lesser numbers of anchor screws 60 can be used. The screw head 62 of the anchor screw 60 abuts against a front surface of the anchor 110 compressing the anchor 110 onto the support beam 80 securing the anchor 110 thereto. In an embodiment, the screw head 62 is received within a countersunk portion 138 of the front surface of the anchor 110. Optionally, the support screw can then be removed.

In an embodiment, the bracket 150 then slidably engages the anchor 110. The block portion 130 slidably engages the socket 158 until the bolt hole 132 of the block portion 130 aligns with the bolt hole 170 of the bracket 150. The user then slides a bolt 64 through the entrance of the bolt hole 170, through the bolt hole 132 of the block portion 130 and threadedly engages a threaded portion 172 of the bolt hole 170 disposed on an opposite side of the socket 158. In an embodiment, the flange 112 is received within the flange recess 156 such that a rear-most surface of the base 152 of the bracket 150 engages a surface of the wall 98.

Advantageously, the stud engaging surface 126 of the anchor 110 extends through the exterior layer 90 to engage a surface of the support beam 80 and mitigate movement of the anchor 110 through either a longitudinal plane, horizontal plane, or a plane extending at an angle therebetween. Further, the flange 112 engages the front surface of the exterior layer to further stabilize the anchor 110 and mitigate longitudinal or horizontal planar movement.

By contrast, bracket systems or similar fastening systems that rest on a front surface of the exterior layer 90 of the wall 98 and include anchor screws extending through the exterior layer 90, and optionally through to the support beam 80, are relatively more susceptible to longitudinal or horizontal planar movement. Such bracket systems are supported away from the support beam 80 by the distance of the exterior layer 90. The compression strength of the exterior layer 90 can be less than that of the support beam 80. As such, the bracket system can be forcibly rotated through the longitudinal or horizontal plane and crush or dent the exterior layer 90 between the bracket and the support beam 80, leading to failure of the bracket system.

Figure 4C:
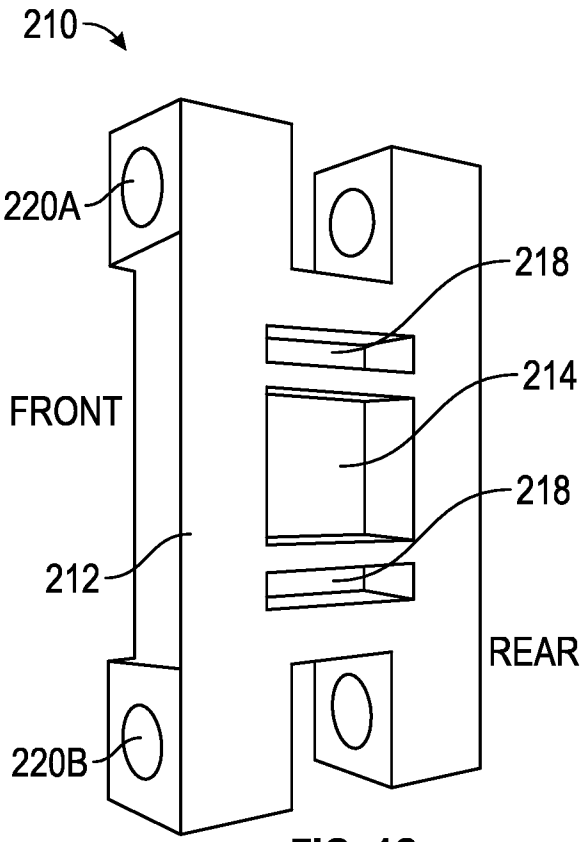
FIG. 4C shows a perspective rear view of a footing of the jig system of FIG. 4A, in accordance with embodiments disclosed herein.
Figure 4B:
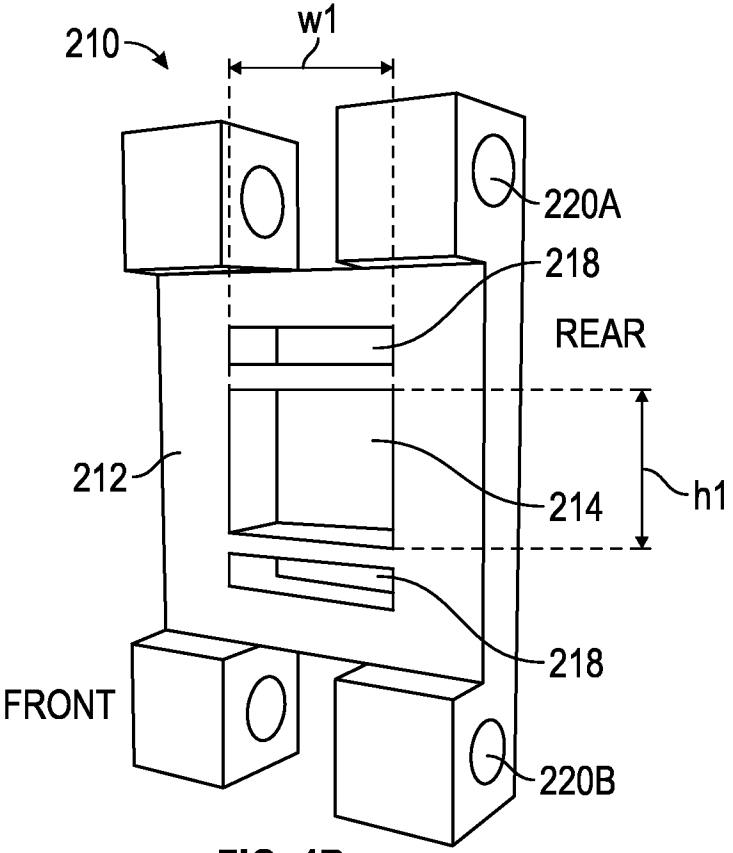
FIG. 4B shows a perspective front view of a footing of the jig system of FIG. 4A, in accordance with embodiments disclosed herein.
Figure 4D:
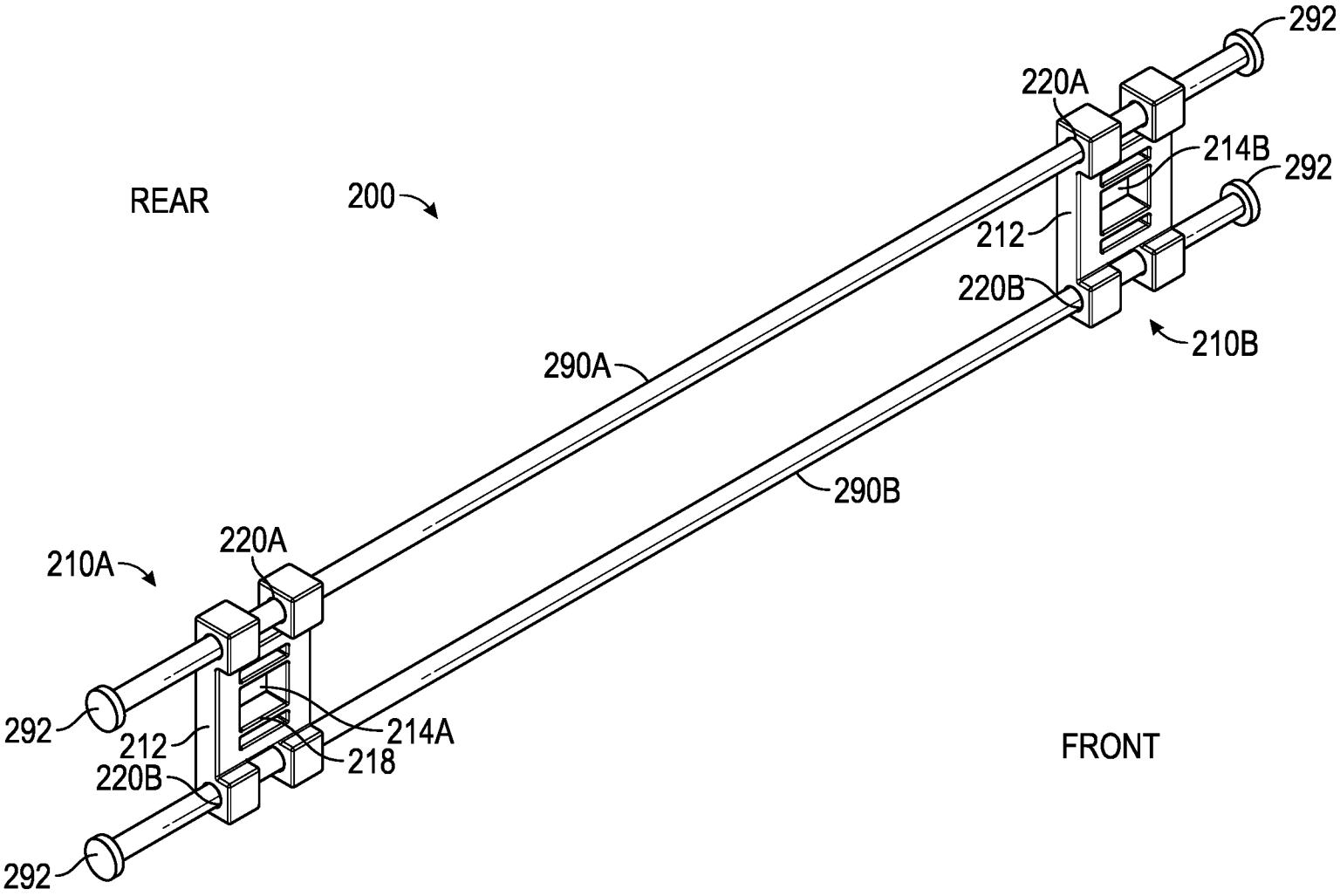
FIG. 4D shows an assembled view of the jig system of FIG. 4A, in accordance with embodiments disclosed herein.

In an embodiment, two or more bracket systems 100 are used to attach structures to a wall surface 98. Exemplary structures include towel rods 190, guide rails, hand rails, shelving supports, picture hangers, TV mounts, exercise equipment, pull-up bars, shower curtain rods, drapes, or the like. As such, aligning the anchors 110 of the two or more bracket systems 100 can be important to ensure the alignment of a first retaining structure 162A with that of a second retaining structure 162B. As shown in FIGS. 4A-4C a jig system 200 is used to ensure correct alignment.

In an exemplary method of use, a first anchor 110A can be secured through a wall exterior layer 90 and engage a first support beam 90A, as described herein. The anchor 110 can be rotated about the longitudinal axis until a vertical axis and/or a horizontal axis of the anchor 110 is correctly aligned, e.g. using a plumb line, spirit level, or the like. In an embodiment, prior to securing the anchor 110 using the support screw or the anchor screw 60, a first footing 210 of the jig 200 engages the anchor 110 by slidably engaging the block portion 130 with the block portion aperture 214. Advantageously, the footing 210 provides a larger surface area with which to support a spirit level device and provide leverage to accurately align the anchor 110. Once the anchor 110 and footing 210 assembly is correctly aligned a support screw is advanced through the support screw slot 218 of the footing 210, through the support screw-hole 118 and engages the exterior layer of the wall 98 to secure the anchor 110 in place. Alternatively, or in addition to, an anchor screw 60 is advanced through an anchor screw hole 116 to secure the first anchor 110A to the first support beam 80A.

In an embodiment, a first end of the first support bar 290A engages the top channel 220A of the first footing 210A and a second end of the first support bar 290A, opposite the first end, engages the top channel 220A of the second footing 210B. Similarly, a first end of the second support bar 290B engages the bottom channel 220B of the first footing 210A, and a second end of the second support bar 290B, opposite the first end, engages the bottom channel 220B of the second footing 210B. A block portion 130 of a second anchor 110B then engages a block portion aperture 214B of the second footing 210B. The user then slides the second anchor 110B and the second footing 210B assembly along a lateral axis until the spike 122 of the second anchor 110B is aligned with a central transverse axis of a second support beam 80B. An abutment 292 prevents the second footing 210B from disengaging the bar 290.

Advantageously, the jig system 200 can quickly and accurately align the second bracket system 100B with a second support beam 80B while maintaining the second bracket system 100B along the same lateral axis as the first bracket system 100A. The user then marks the location of the second anchor 110B, cut the hole through the exterior layer 90 and secure the second anchor 110B directly to the second support beam 80B, as described herein. A first bracket is then coupled to the first anchor 110A and a second bracket is then coupled to the second anchor 110B as described herein. A first end of a rod 190 is engaged with the retainment structure of the first bracket and a second end of the rod 190, opposite the first end, engages the retainment structure of the second bracket to provide a towel rail or the like. In an embodiment the bracket system 100 supports significantly greater loads, for example, loads of 600 lbs. or more depending on the configuration of anchor screws 60, supporting beams, and the like. Advantageously, a towel rail using the bracket system 100 mitigates damage to the wall due to accidental overloading of the bracket system 100.

FIGS. 6A-6D show an embodiment, of a ring bracket system 300 generally including an anchor 310 and a ring bracket 350. In an embodiment, the anchor 310 includes a flange 112, a stud portion 120, a block portion 130, and one or more screw holes 116, as described herein. In an embodiment, the ring bracket 350 includes a base 152 defining an outer perimeter 154, a post 160, a socket 158, a flange recess 156, and a bolt hole 170, as described herein. In an embodiment, the post includes a ring 390 fixedly or hingedly coupled thereto. As such, the ring bracket system 300 can be used as a towel ring, handle, eye bolt, or similar structure configured to secure a ring or hoop to a surface.

In an embodiment, the post 160 is rotatably coupled to the base 152 to allow the post 160, and any structure coupled there to, e.g. ring 390, to rotate about the longitudinal axis of the post 160. In an embodiment, the ring bracket 350 includes a bearing 366 extending from a frontal plane surface of the socket 158 extending longitudinally rearwards into the recess 158. In an embodiment, the anchor 310 includes an anchor recess 136 extending rearwards from a front-most surface of the block portion 130. As such, the bearing extending into the socket 158 is received within the anchor recess 136 when the ring bracket 350 engages the anchor 310. In an embodiment, the anchor screw holes 116 are disposed within the anchor recess 158.

In an embodiment, the bracket bolt hole 170 communicates between the outer perimeter 154 of the base 152 and the socket 158. In an embodiment, the anchor bolt hole 132 communicates with an outer surface of the block portion 130 and the anchor recess 136. As such, with the block portion 130 engaged with the socket 158 the bracket bolt hole 170 aligns with the anchor bolt hole 132 and a bolt 64 engages the bracket bolt hole 170 and the anchor bolt hole 132 to secure the bracket 350 to the anchor 310. One or both of the bracket bolt hole 170 and the anchor bolt hole 132 can be threaded to threadedly engage the bolt 64. In an embodiment, the bolt 64 extends through the anchor bolt hole 132 to engage the bearing 366. In an embodiment, the bolt 64 extends through the anchor bolt hole 132 to engage a surface on an opposite side of the anchor recess 136. In an embodiment, the bolt 64 extends through a first anchor bolt hole 132, across the anchor recess 136 and through a second anchor bolt hole disposed on an opposite side of the anchor recess 136 and communicating with an outer surface of the block portion 130. As such, the bolt 64 engages a threaded portion 172 in the bracket 350 on an opposite side of the socket 158, as described herein.

Figure 7B:
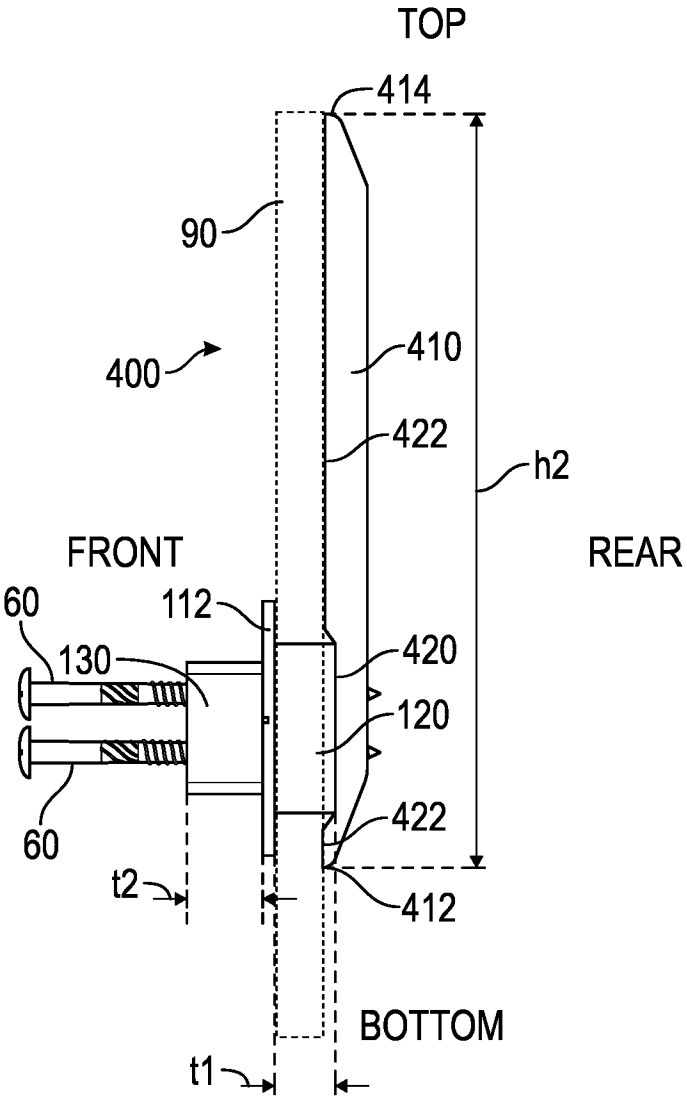
FIG. 7B shows a side view of an anchor and support arm system engaged with an exterior layer of a wall, the exterior layer shown in wire frame, in accordance with embodiments disclosed herein.
Figure 7A:
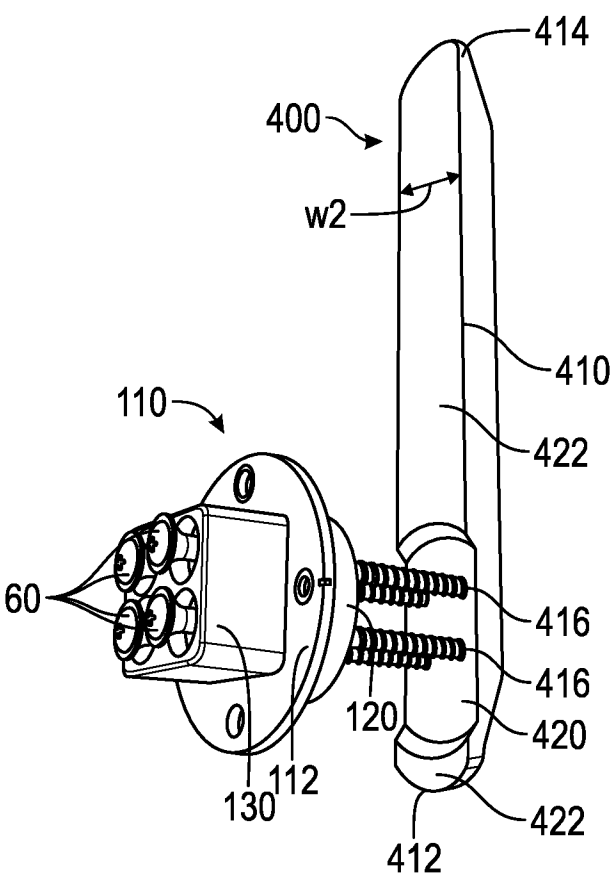
FIG. 7A shows a perspective view of an anchor and support arm system, in accordance with embodiments disclosed herein.

In an embodiment, as shown in FIGS. 7A-7B, the bracket system 100 can further include a support arm system 400. For example, the bracket system 100 described herein may need to be aligned with a portion of the wall 98 that does not include a support beam 80 disposed behind the anchor 110. For example, where a first bracket system 100A is aligned with a support beam 80 and the rod 190 needs to be less than 16 inch. the second bracket system 100B supporting an opposite end of the rod 190 may not align with a second support beam 80. As such, the bracket system 100 further includes a support arm system 400 to secure the anchor to an exterior layer 90 of the wall 98.

The support arm system 400 includes a support arm 410 extending between a first end 412 and a second end 414 to define a second height (h2), and between a first side and a second side to define a second width (w2). In an embodiment, the second height (h2) is between 1.5 and 10 times the first height (h1), although greater and lesser heights are contemplated to fall within the scope of the present invention. In an embodiment, the second width (w2) is equal to or greater than the first width (w1). In an embodiment, the second width (w2) is equal to or less than the second diameter (d2). However, it will be appreciated that greater and lesser widths of the second width (w2) are contemplated to fall within the scope of the present invention.

In an embodiment, the support arm 410 includes one or more anchor screw holes 416 disposed adjacent the first end 412. Each anchor screw hole of the one or more anchor screw holes 416 aligns with an anchor screw hole 116 of the anchor 110. A diameter of the anchor screw hole 416 is less than an outer diameter of the anchor screw 60 so that the anchor screw 60 engages the hole 416 in an interference fit.

In an embodiment, the support arm 410 defines a wall engaging surface 422 extending over a front surface of the support arm 410 and configured to engage a rear surface of the exterior layer 90. In an embodiment, a surface of the support arm 410, e.g. wall engaging surface 422, includes a textured surface. Exemplary textured surfaces can include, but not limited to one or more bumps, ridges, ribs, spikes, protrusion, pyramid-shaped protrusions, knurling, or the like, configured to engaged the rear surface of the exterior layer 90 and mitigating slippage therebetween. In an embodiment, a surface of the support arm 410, e.g. wall engaging surface 422, includes a second material with an increased frictional co-efficient and configured to mitigate slippage between the support art and the exterior layer 90. In an embodiment, the support arm 410 further includes a skive, defining a recess surface 420 extending parallel to the wall engaging surface 422 and disposed rearwards of the wall engaging surface 422 along a longitudinal axis. The recess surface 420 extends about the one or more anchor screw holes 416 and defines a diameter equal to, or slightly larger than the second diameter (d2) of the stud portion 120. As such, as the anchor screws 60 tighten, the screws 60 compress a rear-most surface of the anchor 110 onto the recess surface 420 of the support arm 410 with the stud portion 120 aligning with the skive. As shown in FIG. 7B, the recess surface 420 is disposed rearwards of the wall engaging surface 422. As such, with the rear-most surface of the anchor 110 engaging the recess surface 420, the wall engaging surface 422 is urged forwards into the rear surface of the exterior layer 90, applying pressure thereto. Advantageously, as shown in FIG. 7B, where a thickness of the exterior layer 90 can vary and is equal to or slightly less than the first thickness (t1) of the stud portion 120, the longitudinal distance of the recess surface 420 relative to the wall engaging surface 422 ensures the wall engaging surface 422 of the support arm 410 is compressed tightly against the rear surface of the exterior layer 90.

In an exemplary method of use, an anchor 110 can be aligned with an exterior wall surface 90 and a hole cut therethrough to a diameter equal to, or slightly larger than the second diameter (d2). As shown in FIG. 7A, a tip of one or more anchor screws 60 extends through the anchor screw holes 116 of the anchor 110 and engages an anchor screw hole 410 of the support arm 410. Due to the length of the screw(s) 60, the support arm 410 and the anchor 110 are in a spaced apart relationship. The support arm 410 is then fed through the hole in the exterior layer 90 until a first end 412 engages a rear side of the exterior layer 90 on a first side of the hole, and the second end 414 engages a rear side of the exterior layer 90 on a second side of the hole, opposite the first side.

As will be appreciated, the second end 414 extends further from the anchor 110 than the first end 412, and as such provides mechanical advantage to resist pivoting of the bracket and arm system 100, 400 through a plane aligned with the support arm 410. Once the support arm 410 is seated on the rear side of the exterior layer 90, the anchor 110 and support arm 410 assembly can be rotated about the longitudinal axis until the support arm 410 is aligned as required. For example, as shown in FIG. 7B the second end 414 can be aligned upwards along a transverse (vertical) axis to provide mechanical advantage against a downward transverse force that might rotate the bracket system through a longitudinal plane. As will be appreciated, the anchor 110 can be rotated until the second end 414 is aligned with other axes, as required.

Once correctly aligned, the anchor screws 60 can be tightened to compress the anchor 110 onto the support arm 410 and, optionally, compress a portion of the exterior layer 90 between a portion of the flange 112 and a portion of the support arm 410, securing the anchor 110 in place. The bracket 150 can be secured to the anchor 110 as described herein.

Figure 8A:
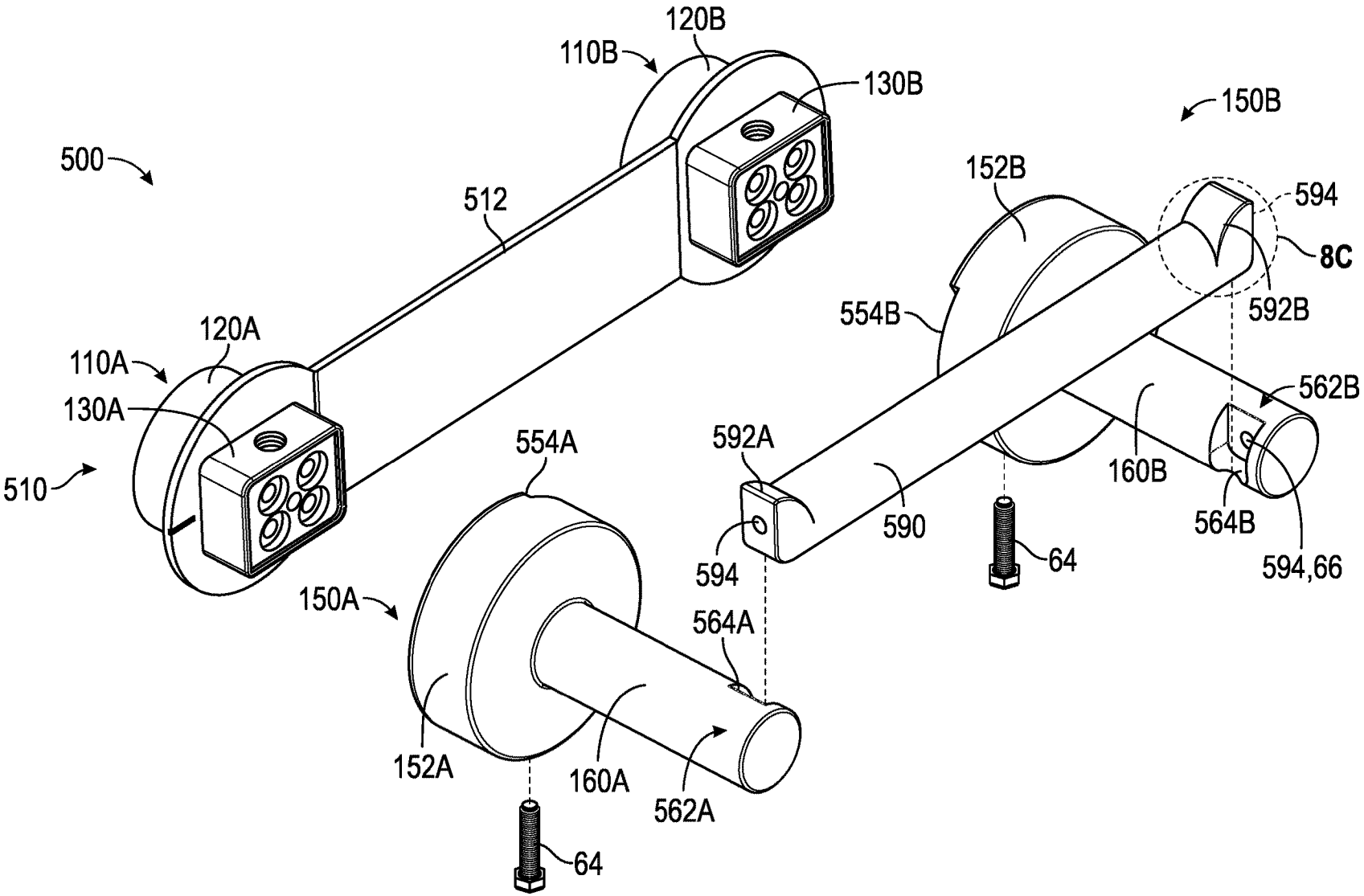
FIG. 8A shows a perspective exploded view of a dual anchor and bracket system, in accordance with embodiments disclosed herein.
Figure 8B:
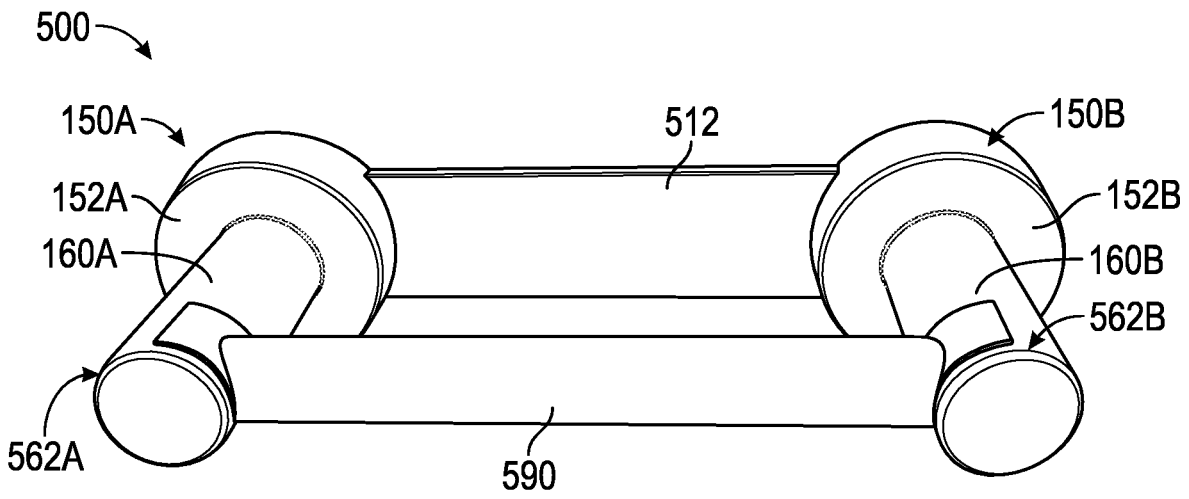
FIG. 8B shows a front view of a dual anchor and bracket system, in accordance with embodiments disclosed herein.
Figure 8C:
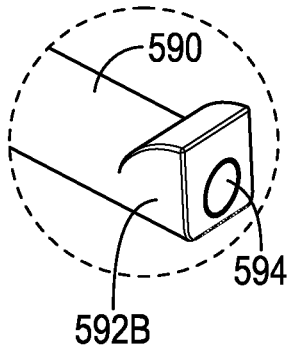
FIG. 8C shows close up detail the system of FIG. 8A, in accordance with embodiments disclosed herein.
Figure 8D:
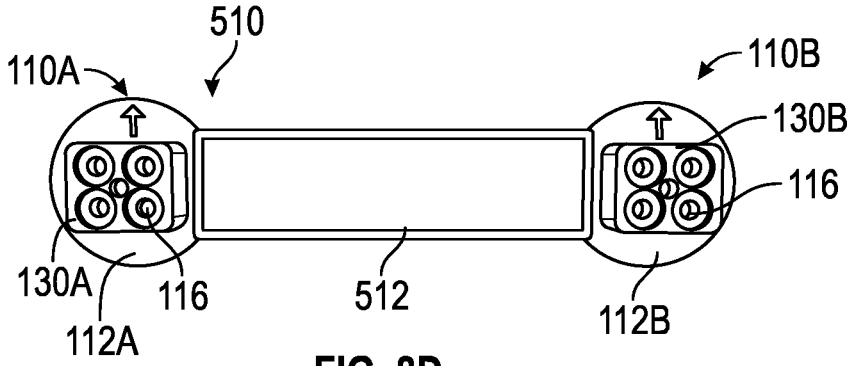
FIG. 8D shows a front view of the dual anchor of the system of FIG. 8A, in accordance with embodiments disclosed herein.

FIGS. 8A-8D show and embodiment of a dual anchor bracket system 500. FIG. 8A shows an exploded view of the dual anchor bracket system 500. FIG. 8B shows a perspective view of the dual anchor bracket system 500. FIG. 8C shows close up detail of the dual anchor bracket system 500. FIG. 8D shows a front view of the anchor system 510 of the dual anchor bracket system 500. The dual anchor bracket system 500 generally includes an anchor system 510 having a first anchor 110A and a second anchor 110B coupled together with a supporting flange 512 extending between the first flange 112A and the second flange 112B. In an embodiment, the first anchor 110A, second anchor 110B and support flange 512 are formed integrally, as a single monolithic piece. In an embodiment, the first anchor 110A, second anchor 110B and support flange 512 are formed as separate structures and coupled together using adhesive, bonding, welding, or the like. Each of the first anchor 110A and the second anchor 110B includes a stud portion 120 and a block portion 130, one or more anchor screw holes 116, and bolt hole 132, etc., as described in embodiments herein.

The dual anchor bracket system 500 further includes a first bracket 150A configured to engage the first anchor 110A and a second bracket 150B configured to engage the second anchor 110B. Each of the first bracket 150A and the second bracket 150B includes a base 152 and a post 160, as described in embodiments herein. In an embodiment, the base 152 of the bracket 150 includes a notch 554 extending between the outer perimeter 154 and the flange recess 156 of each of the first bracket 150A and the second bracket 150B. For example, the first bracket 150A includes a first notch 554A and the second bracket 150B includes a second notch 554B. When the bracket 150 engages the anchor 110, a portion of the supporting flange 512, coupled with the flange 112 of the anchor 110 extends through the notch 554.

In an embodiment, the post 160 of the bracket 150 includes a retaining structure 562, for example the first post 160A includes a first retaining structure 562A and the second post 160B includes a second retaining structure 562B. The retaining structure 562 includes a recess 564 extending into the post 160 along a frontal plane, i.e. along both the lateral and transverse axes, and configured to receive an end portion 592 of a rod 590.

As such, when the rod 590 is engaged with both the first bracket 150A and the second bracket 150B, the rod 590 extends from the first recess 564A and the second recess 564B along the lateral axis between the first retaining structure 562A and the second retaining structure 562B. Further, with the first bracket 150A and the second bracket 150B secured in place on the wall 98, the rod 90 can disengage the first bracket 150A and the second bracket 150B by sliding the rod 590 along the transverse axis to disengage the first end 592A from the first retaining structure 562A and the second end 592B from the second retaining structure 562B.

Advantageously, the supporting flange 512 holds the first anchor 110A and bracket 150A assembly at a predetermined distance from the second anchor 110B and bracket 150B assembly. This predetermined distance allows for the rod 590 to be received securely within the first retaining structure 562A and the second retaining structure 562B and preventing any movement of the rod 590 along a lateral axis therebetween. Further, the supporting flange 512 prevents the first anchor 110A being spaced too close to the second anchor 110B which might prevent the rod 590 from engaging the first retaining structure 562A and the second retaining structure 562B correctly.

In an embodiment, one or more of the first retaining structure 562A and the second retaining structure 562B engages the first end 592A and the second end 592B of the rod 590 in an interference fit, press-fit, or snap-fit engagement. In an embodiment, one or more of the first retaining structure 562A, the second retaining structure 562B, the first end 592A and the second end 592B of the rod 590 includes one or more of a protrusion, detent, pawl, abutment, clip, latch, or similar structure configured to releasably retain the first end 592A and the second end 592B of the rod 590 within the first retaining structure 562A and the second retaining structure 562B, respectively.

In an embodiment, one or more of the first retaining structure 562A, the second retaining structure 562B, the first end 592A and the second end 592B of the rod 590 includes a magnetic element 594. As used herein, a magnetic element includes a permanent magnet, a portion of ferrous metal, a portion of magnetizable material, an electromagnet, or the like. Advantageously, the magnetic element(s) 594 can facilitate retaining the rod 590 with the bracket 150, or more specifically, retaining one or both of the first end 592A and the second end 592B of the rod 590 with the first retaining structure 562A and the second retaining structure 562B, respectively.

In an embodiment, one or more of the magnetic elements 594 includes a bolt 66 threadedly engaged with one or more of the first retaining structure 562A, the second retaining structure 562B, the first end 592A and the second end 592B of the rod 590. Advantageously, rotating the bolt 66 adjusts the lateral distance between the magnetic element(s) 594 and the rod 590 and can "fine-tune" the distance therebetween. This allows the rod 590 to be securely retained by the brackets 150A, 150B, while still allowing the rod 590 to selectively disengage the brackets 150A, 150B.

In an exemplary method of use, a user aligns one or both of the first anchor 110A and the second anchor 110B on the exterior layer 90 of a wall 98, and drills a hole through the exterior layer 90 to receive the stud portion 120 therethrough, as described herein. In an embodiment, a user attaches one or both of the first anchor 110A and the second anchor 110B to a supporting beam 80, disposed behind the exterior layer 90. Optionally, a user attaches one or both of the first anchor 110A and the second anchor 110B to the exterior layer 90 using a support arm system 400, as described herein. To note, with the first anchor 110A and the second anchor 110B secured to the wall 98, the support flange 512 extends over a front surface of the exterior layer 90 between the first anchor 110A and the second anchor 110B. Optionally, the support flange 512 extends through a portion of the exterior layer 90 between the first anchor 110A and the second anchor 110B.

With the first anchor 110A and the second anchor 110B secured in place a first bracket 150A is coupled with the first anchor 110A and a second bracket is coupled with the second anchor 110B using one or more bolts 64, as described herein. Advantageously, the first notch 554A and the second notch 554B ensure that the first retaining structure 562A is correctly oriented with respect to the second retaining structure 562B. Further, the support flange 512 ensures the first bracket 150A and first retaining structure 562A, is correctly spaced from the second bracket 150B, and second retaining structure 562B. The rod 590 is then received, along the transverse axis, into the receiving structures 562A, 562B. The rod 590 can be releasably secured in place using one or more of an interference fit, press-fit, snap-fit, protrusion, detent, pawl, abutment, clip, latch, or magnetic element 594, as described herein.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A dual anchor bracket system for coupling to a wall having an exterior layer and a support beam, the bracket system comprising:

a first anchor including a first flange, a first stud portion extending from a rear surface of the first flange, and a first block portion extending from a front surface of the first flange;

a second anchor including a second flange, a second stud portion extending from a rear surface of the second flange, and a second block portion extending from a front surface of the second flange;

a support flange extending between the first flange and the second flange;

a first bracket configured to engage the first block portion;

a second bracket configured to engage the second block portion; and a rod configured to engage one or both of the first bracket and the second bracket.

2. The dual anchor bracket system according to claim 1, wherein the first anchor, the second anchor, and the support flange are formed integrally as a single monolithic structure.

3. The dual anchor bracket system according to claim 1, wherein the first bracket includes a first receiving structure having a first recess extending along a first transverse axis and a first lateral axis, and wherein the second bracket includes a second receiving structure having a second recess extending along a second transverse axis and a second lateral axis.

4. The dual anchor bracket system according to claim 3, wherein the first recess is configured to retain a first end of the rod, and the second recess is configured to retain a second end of the rod.

5. The dual anchor bracket system according to claim 4, wherein one or more of the first recess, the second recess, the first end, and the second end of the rod includes a magnetic element configured to releasably retain the first end of the rod within the first receiving structure or the second end of the rod within the second receiving structure.

6. The dual anchor bracket system according to claim 5, wherein one or more of the first recess, the second recess, the first end of the rod, and the second end of the rod includes a bolt threadedly engaged therewith and configured to adjust a lateral distance between the magnetic element and the rod.

7. The dual anchor bracket system according to claim 5, wherein one or more of the first recess, the second recess, the first end of the rod, and the second end of the rod includes one of an interference fit, a press-fit, a snap-fit, a protrusion, a detent, a pawl, an abutment, a clip, or a latch configured to releasably retain the rod.

8. The dual anchor bracket system according to claim 1, wherein one or both of the first anchor and the second anchor includes a notch communicating between a flange recess and an outer perimeter and configured to receive a portion of the support flange therein.

* * * * *